United States Patent [19]

Kubodera et al.

[11] Patent Number: 4,713,316

[45] Date of Patent: Dec. 15, 1987

[54] HEAT-DEVELOPABLE PHOTOGRAPHIC MATERIALS

[75] Inventors: Seiiti Kubodera; Toshinao Ukai; Hisashi Okada, all of Kanagawa, Japan

[73] Assignee: Fuji Photo Film Co., Ltd., Kanagawa, Japan

[21] Appl. No.: 804,420

[22] Filed: Dec. 4, 1985

[30] Foreign Application Priority Data

Dec. 5, 1984 [JP] Japan ..... 59-257255

[51] Int. Cl.[4] ..... G03C 1/14; G03C 5/00

[52] U.S. Cl. ..... 430/351; 430/353; 430/560; 430/562; 430/583; 430/584; 430/617; 430/619; 430/620; 430/522; 430/203

[58] Field of Search ..... 430/583, 584, 617, 619, 430/620, 522, 351, 353, 560, 562, 203, 618

[56] References Cited

U.S. PATENT DOCUMENTS

| | | | |
|---|---|---|---|
| 3,690,891 | 9/1972 | Spence et al. | 430/584 |
| 3,933,507 | 1/1976 | Von Konig | 430/584 |
| 4,515,888 | 5/1985 | Beretta et al. | 430/584 |

OTHER PUBLICATIONS

*Research Disclosure,* 17643, Dec. 1978, p. 22 & p. 30.

*Primary Examiner*—Won H. Louie
*Attorney, Agent, or Firm*—Sughrue, Mion, Zinn, Macpeak & Seas

[57] ABSTRACT

A heat-developable photographic material having improved preservability, which comprises a support having thereon at least one heat-developable photographic layer, said photographic material containing a dye represented by formula (I)

wherein n and m each represents 0, 1, 2 or 3;

p and q each represents 0 or 1;

L represents a methine group or a substituted methine group;

$R_1$ and $R_2$ are same or different and each represents an unsubstituted or substituted alkyl group;

$R_3$ and $R_4$ are same or different and each represents a hydrogen atom, an alkyl group, an alkoxy group, a hydroxyl group, an unsubstituted or substituted amino group or a halogen atom; or said $R_3$ and $R_4$ form a condensed 6-membered ring;

Z and Z' are same or different and each represents a non-metallic atomic group necessary for forming a substituted or unsubstituted 5-membered or 6-membered ring, or substituted or unsubstituted 5-membered or 6-membered ring which is condensed with another ring;

$X^{\ominus}$ represents an anion;

r represents 1 or 2, and when the dye forms an internal salt, r is 1.

21 Claims, No Drawings

HEAT-DEVELOPABLE PHOTOGRAPHIC MATERIALS

FIELD OF THE INVENTION

The present invention relates to heat-developable photographic materials, and particularly to such materials having improved preservability.

BACKGROUND OF THE INVENTION

Photographic techniques using a silver halide have heretofore been most widely utilized, since the photographic characteristics thereof, such as sensitivity, gradation control, etc., are superior to those of other photographic techniques such as electrophotography or diazo photography. Recently, an improved photographic technique has been developed capable of simply and rapidly forming an image, where the image-formation of a silver halide-containing photographic material is carried out by means of a dry process using heat instead of a conventional wet process using a developing liquid or the like.

A heat-developable photographic material is known in this technical field, and various heat-developable photographic material and processes thereof are described, for example, in *Bases of Photographic Industry,* Corona Publishing, 1979, pp. 553–555; *Film Information* (April, 1978), p. 40; *Neblette's Handbook of Photography and Reprography,* 7th Ed., Van Nortrand Reinhold Company, 1977, pp. 32–33; U.S. Pat. Nos. 3,152,904, 3,301,678, 3,392,020 and 3,457,075; British Pat. Nos. 1,131,108 and 1,167,777; and *Research Disclosure,* RD No. 17029 (June, 1978), pp. 9–15.

Many processes have been proposed for formation of color images. As for means for formation of color imaged due to binding of a developing agent, as oxidized, and a coupler, U.S. Pat. No. 3,531,286 describes a combination of a p-phenylene-diamine reducing agent and a phenolic or active methylene-coupler; U.S. Pat. No. 3,761,270 describes a p-aminophenol reducing agent; Bergian Pat. No. 802,519 and *Research Disclosure,* RD No. 13742 (September, 1975), pp. 31–32 describe a sulfonamidophenol reducing agent; and U.S. Pat. No. 4,021,240 describes a combination of a sulfonamidophenol reducing agent and a four-equivalent coupler.

Other methods for formation of positive color images include a photographic silver dye-bleaching process, as described, for example, in *Research Disclosure,* RD No. 14433 (April, 1976), pp. 30–32 and RD No. 15227 (December, 1976), pp. 14–15, and U.S. Pat. No. 4,235,957, which disclose useful dyes and bleaching processes.

In addition, European Patent Publication (unexamined) Nos. 76,492 and 79,056 and Japanese Patent Application (OPI) Nos. 28928/83 and 26008/83 disclose a method for formation of color images by heat-development, using a compound essentially having a dye moiety and capable of releasing a mobile dye corresponding or reversely corresponding to the reduction reaction to reduce a silver halide to silver at a high temperature. The term "OPI" indicates an unexamined patent application open to public inspection.

In said image-forming methods, an alkaline agent or an alkali precursor is generally incorporated in a photographic material, in order to accelerate the development of said material under heat. However, such photographic materials as comprising a combination of a silver halide emulsion which has been color-sensitized with a sensitizing dye and an alkaline agent or an alkali precursor have a serious defect in that the sensitivity of the material is usually lowered during the preservation thereof.

In particular, in the case that a color-sensitized silver halide is used in a photographic system containing said dye and a compound capable of releasing a mobile dye corresponding to or reversely corresponding to the reduction reaction or reducing said silver halide to silver at a high temperature, the preservation stability of the material is especially remarkably lowered. The reason is thought to be as follows: As the dye-releasing compound itself has a dye moiety, it thereby has characteristics of a dye, and so, if said dye-releasing compound is co-used together with a silver halide which has been color-sensitized with a sensitizing dye, said dye-releasing compound may react with said sensitizing dye which has adsorbed to the silver halide, resulting in desorption of said sensitizing dye from the surface of the silver halide during preservation (before use) of the photographic material. Such defect can be fatal in color photographic materials or other photographic materials in the case of the electromagnetic radiation falling outside of the range of the intrinsic sensitivity of a siler halide.

SUMMARY OF THE INVENTION

An object of the present invention is to overcome said problems in the prior art, and to provide a heat-developable photographic material of high stability, which can maintain a determined sensitivity during preservation for a long period of time.

The present invention provides a heat-developable photographic material comprising a support having thereon at least one heat-developable photographic layer, said photographic material containing a dye represented by formula (I)

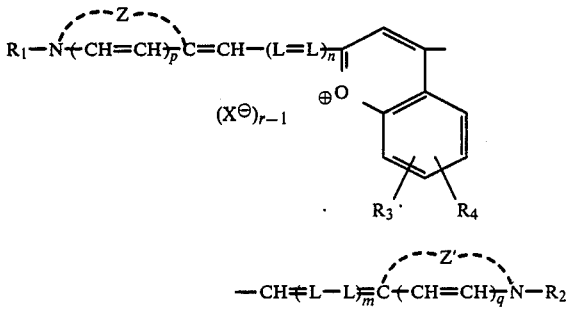

wherein n and m each represent 0, 1, 2, or 3;

p and q each represents 0 or 1;

L represents a methine group or a substituted methine group;

$R_1$ and $R_2$ are same or different and each represents an unsubstituted or substituted alkyl group;

$R_3$ and $R_4$ are same or different and each represents a hydrogen atom, an alkyl group, an alkoxy group, a hydroxyl group, an unsubstituted or substituted amino group or a halogen atom; or $R_3$ and $R_4$ form a condensed 6-membered ring;

Z and Z' are same or different and each represents a non-metallic atomic group necessary for forming a 5-membered or 6-memebered ring, which may optionally be substituted, or may optionally be condensed with any other ring;

$X^{\ominus}$ represents an anion;

r represents 1 or 2, and when the dye forms an internal salt, r is 1.

DETAILED DESCRIPTION OF THE INVENTION

Preferred substituents in the general formula (I) are mentioned below.

$R_1$ and $R_2$ are same or different and each represents an unsubstituted alkyl group having from 1 to 18 carbon atoms (such as methyl group, ethyl group, propyl group, butyl group, pentyl group, octyl group, decyl group dodecyl group, octadecyl group, vinylmethyl group, cyclohexyl group, etc.); or a substituted alkyl group having from 1 to 18 carbon atoms and substituted by a carboxyl group, a sulfo group, $-COO^{\ominus}$, $-SO_3^{\ominus}$, a cyano group, a halogen atom (such as fluorine atom, chlorine atom, and bromine atom), a hydroxyl group, an alkoxy-carbonyl group having from 2 to 8 carbon atoms (such as methoxycarbonyl group, ethoxycarbonyl group, and benzyloxycarbonyl group), an aryloxycarbonyl group having from 7 to 8 carbon atoms (such as phenoxycarbonyl group), an alkoxy group having from 1 to 8 carbon atoms (such as methoxy group, ethoxy group, benzyloxy group, and phenethyloxy group), a mono-cyclic aryloxy group having from 6 to 10 carbon atoms (such as phenoxy group, and p-tolyloxy group), an alkylcarbonyloxy group having preferably from 2 to 8, more preferably 2 to 3 carbon atoms (such as acetyloxy group and propionyloxy group), an arylcarbonyloxy group having from 7 to 8 carbon atoms (such as benzoyloxy group), an alkylcarbonyl group having from 2 to 8 carbon atoms (such as acetyl group and propionyl group), an arylcarbonyl group having from 7 to 8 carbon atoms (such as benzoyl group), an alkylsulfonyl group having from 1 to 8 carbon atoms (such as mesyl group), an arylsulfonyl group having from 6 to 8 carbon atoms (such as benzenesulfonyl group), a carbamoyl group, a substituted carbamoyl group (such as N,N-dialkylcarbamoyl group, e.g., N,N-dimethylcarbamoyl group; morpholinocarbonyl group; and piperidinocarbonyl group), a sulfamoyl group, a substituted sulfamoyl group (such as N,N-dialkylsulfamoyl group, e.g., N,N-dimethylsulfamoyl group; morpholinosulfonyl group; and piperidinosulfonyl group), and an aryl group having from 6 to 10 carbon atoms or a substituted aryl group having from 6 to 10 carbon atoms and substituted with a halogen atoms such as fluorine atom, chlorine atom, and bromine atom (e.g., phenyl group, 4-chlorophenyl group, 4-methylphenyl group, and $\alpha$-naphthyl group).

L represents a methine group or a substituted methine group, and the substituent on the methine group is preferably an alkyl group having from 1 to 4 carbon atoms (such as methyl group, ethyl group, propyl group, and butyl group), an aryl-substituted alkyl group having from 7 to 10 carbon atoms (such as benzyl group, phenethyl group, 3-phenylpropyl group, 4-phenylbutyl group), an aryl group having from 6 to 10 carbon atoms (such as phenyl group, and naphthyl group), etc.

The substituents of L may form a ring, preferably 6-membered ring, with carbon atoms of L. An example of the ring is

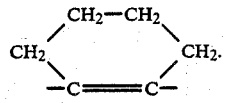

$R_3$ and $R_4$ each represent an alkyl group, preferaly a lower alkyl group having from 1 to 4 carbon atoms (such as methyl group, ethyl group, isopropyl group, and butyl group); or an alkoxy group, preferably having from 1 to 4 carbon atoms (such as methoxy group, ethoxy group, propoxy group, and butoxy group).

$R_3$ and $R_4$ each represents an unsubstituted or substituted amino group represented by group

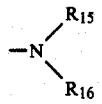

wherein $R_{15}$ and $R_{16}$ are same or different and each represents a hydrogen atom, a lower alkyl group having from 1 to 4 carbon atoms (such as methyl group, ethyl group, propyl group, and butyl group) or an alkylcarbonyl group having from 2 to 8 carbon atoms (such as acetyl group and propionyl group), and an arylcarbonyl group having from 7 to 8 carbon atoms (such as benzoyl group).

It is also preferable that $R_{15}$ and $R_{16}$ together form a 5-membered or 6-membered ring.

$R_{15}$ and/or $R_{16}$ may form a condensed ring combined the benzene ring of the benzopyrilium nucleus.

Z and $Z_1$ each represents a non-metallic atomic group necessary for forming a substituted or unsubstituted 5-membered or 6-membered ring. The ring may be combined with another ring to form a condensed ring which may also be substituted. Examples for substituents include a halogen atom, an alkyl group, an aryl group, a trifluoromethyl group, an alkoxy group, a carboxy group, a cyano group and a hydroxy group. Preferable examples for ring include a substituted or unsubstituted thiazole nucleus (such as thiazole, 4-methylthiazole, 4-phenylthiazole, 5-methylthiazole, 5-phenylthiazole, 4,5-dimethylthiazole, 4,5-diphenylthiazole, 4-(2-thienyl)thiazole), a substituted or unsubstituted benzothiazole nucleus (such as benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-trifluoromethylbenzothiazole, 5-phenylbenzothiazole, 4-methoxybenzothiazole, 5-methoxybenzothiazole, 6-methoxybenzothiazole, 5-carboxybenzothiazole, 5-cyanobenzothiazole, 5-fluorobenzothiazole, 5-ethoxybenzothiazole, tetrahydrobenzothiazole, 5,6-dimethoxybenzothiazole, 5-hydroxybenzothiazole, 6-hydroxybenzothiazole), a substituted or unsubstituted naphthothiazole nucleus (such as naphtho-[1,2-d]thiazole, naphtho-[2,1-d]thiazole, naphtho[2,3-d]thiazole, 5-methoxynaphtho[2,1-d]thiazole, 5-ethoxynaphtho[2,1-d]thiazole, 8-methoxynaphtho[1,2-d]thiazole, 7-methoxynaphtho[1,2-d]thiazole), a substituted or unsubstituted oxazole nucleus (such as 4-methyloxazole, 5-methyloxazole, 4-phenyloxazole, 4,5-diphenyloxazole, 4-ethyloxazole, 4,5-dimethyloxazole, 5-phenyloxazole), a substituted or unsubstituted benzoxazole nucleus (such as benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-methoxybenzoxazole, 5-ethoxybenzoxazole, 5-fluorobenzoxazole, 6-methoxybenzoxazole, 5-hydroxybenzoxazole, 6-hydroxybenzoxazole), a substituted or unsubstituted naphthoxazole nucleus (such as naphtho[1,2-d]oxazole, naphtho[2,1-d]oxazole, naphtho[2,3-d]oxazole), a substituted or unsubstituted selenazole nucleus (such as selenazole, 4-methylselenazole, 4-phenylselenazole, 4,5-diphenylselenazole), a substituted or unsubstituted benzoselenazole nucleus (such as benzoselenazole, 5-chlorobenzoselenazole, 5-methylbenzoselenazole, 5-methoxybenzoselenazole, 5-phenylbenzoselenazole), a substituted or unsubstituted naphthoselenazole (such as naphtho[1,2-d]selenazole, naphtho[2,1-d]selenazole, naptho[2,3-d]selenazole), a substituted or unsubstituted imidazole nucleus (such as 1-ethylimidazole, 1-benzylimidazole), a substituted or unsubstituted benzimidazole nucleus (such as 1,3-diethylbenzimidazole, 1,3-diethyl-5,6-dichlorobenzimidazole, 1,3-diethyl-5-trifluoromethyl-6-chlorobenzimidazole, 1,3-diethyl-5-cyano-6-chlorobenzimidazole), a substituted or unsubstituted naphthoimidazole nucleus (such as 1H-naphtho[2,3-d]imidazole), a substituted or unsubstituted thiazoline nucleus (such as thiazoline, 4-methylthiazoline, 4-phenylthiazoline), a substituted or unsubstituted imidazoquinoline nucleus (such as 1H-imidazo[4,5-b]quinoline), a substituted or unsubstituted imidazo[4,5-b]quinoxaline nucleus (such as 1,3-diethylimidazo[4,5-b]quinoxaline, 1,3-diallylimidazo[4,5-b]quinoxaline, 1,3-diphenylimidazo[4,5-b]quinoxaline, 6-chloro-1,3-diethyl-imidazo[4,5-b]quinoxaline, 6-chloro-1,3-diallylimidazo[4,5-b]quinoxaline, 6,7-dichloro-1,3-diphenylimidazo[4,5-b]quinoxaline), a substituted or unsubstituted oxazoline nucleus (such as 5,5-dimethyloxazoline), a substituted or unsubstituted isoxazole nucleus (such as 5-methylisoxazole), a substituted or unsubstituted benzisoxazole nucleus (such as benzisoxazole), a substituted or unsubstituted 3,3-dialkylindolenine nucleus (such as 3,3-dimethylindolenine, 3,3,5-trimethylindolenine, 5-chloro-3,3-dimethylindolenine, 5-ethoxycarbonyl-3,3-dimethylindolenine), a substituted or unsubstituted 2-pyridine nucleus (such as pyridine, 5-methylpyridine), a 4-pyridine nucleus (such as pyridine), a substituted or unsubstituted 2-quinoline nucleus (such as 6-ethoxyquinoline, 6-ethylquinoline, 6-chloroquinoline, 8-fluoroquinoline), a substituted or unsubstituted 4-quinoline nucleus (such as 8-methylquinoline, 8-fluoroquinoline, 6-chloroquinoline), a substsituted or unsubstituted 1-isoquinoline nucleus (such as isoquinoline), etc.

$X^{\ominus}$ represents an anion, for example, chloride ion, bromide ion, iodide ion, thiocyanate ion, perchlorate ion, paratoluene-sulfonate ion, tetrafluoro-borate ion, etc.

Compounds of the formula (I) may be synthesized by means of various processes, and, for example, they may be obtained according to the following reaction formulae, in which an intermediate (A) obtained by reacting an active methyl-containing heterocyclic quaternary salt derivative and a 4-methylcoumarin-2-thione derivative is reacted with a compound (B).

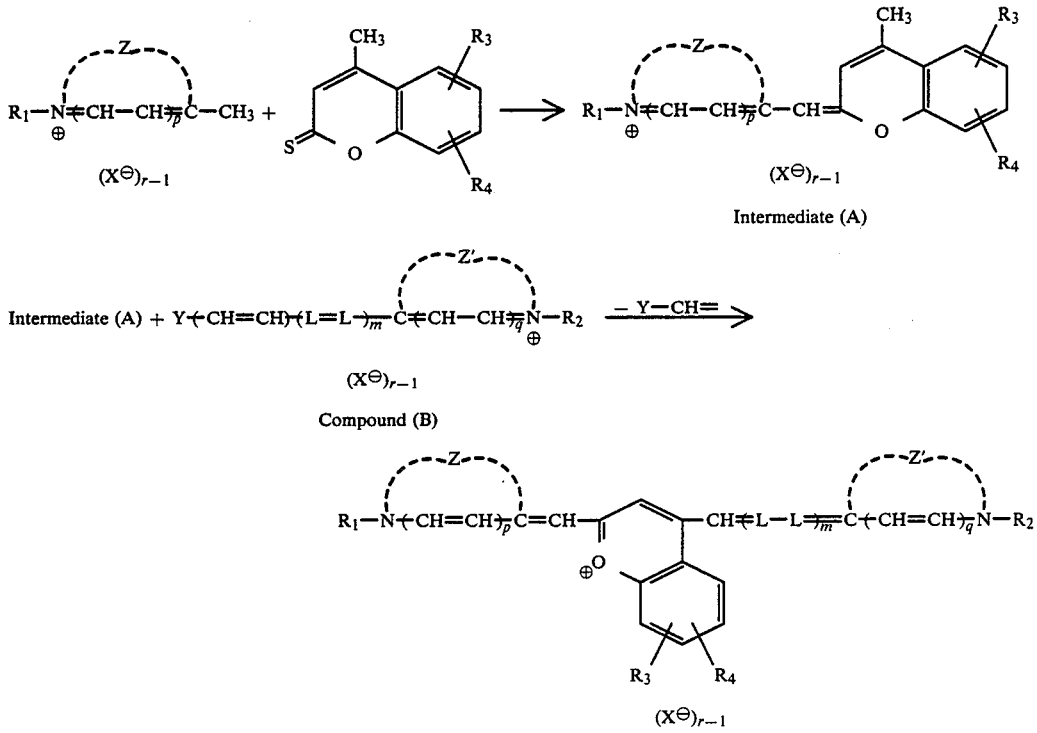

In the above reaction formulae, Y represents a removable group (with —CH=) which is conventionally used in synthesis of dyes, for example, a halogen atoms (such as chlorine atom), a substituted amino group (such as N-acetylanilino group, and dimethyl-amino group), a substituted mercapto group (such as methylthio group, ethylthio group, 3-sulfopropylthio group, and 4-sulfobutylthio group), a sulfonate group, an alkoxy or aryloxy group (such as methoxy group, ethoxy group, and phenoxy group), etc.

$X^{\ominus}$ represents an anion.

r represents 1 or 2, and when the molecule forms an internal salt, r is 1.

The other $R_1$, $R_2$, $R_3$, $R_4$, Z, Z', m, p and q have the same meanings as in the formula (I).

Apart from the above-described process, the present compounds of the formula (I) may be obtained by a method as described in U.S. Pat. No. 3,831,105; a method as described in "Ukr. Khim. Zh.", Vol. 9, pp. 965–971 (1980); a method as described in "Research Disclosure" No. 163, pp. 29–32 (1977); etc.

Examples of the present compounds of the formula (I) are given below, which, do not whatsoever restrict the scope of the present invention.

Compound 1

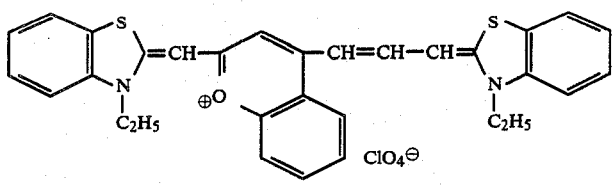

Compound 2

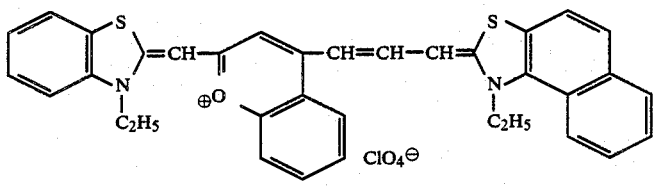

Compound 3

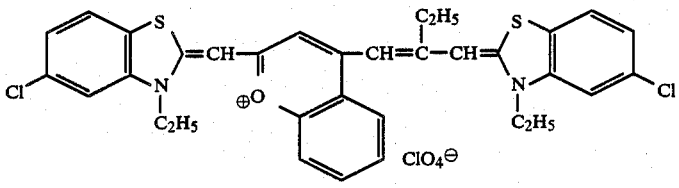

Compound 4

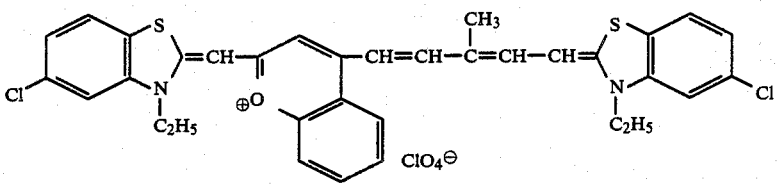

Compound 5

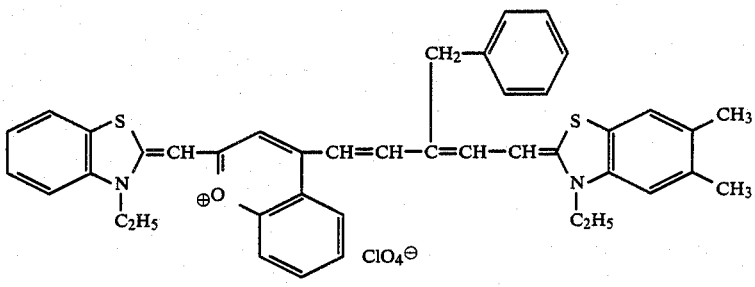

Compound 6

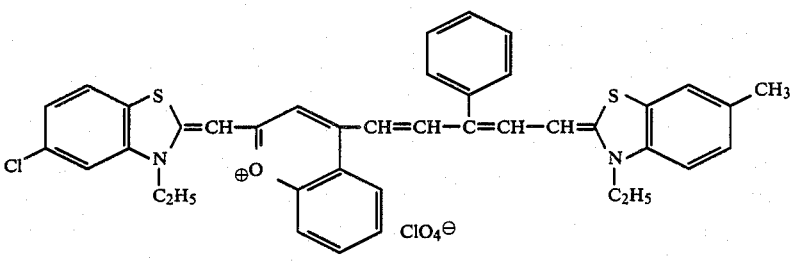

-continued
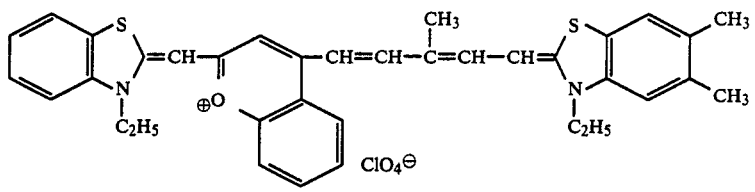
Compound 7
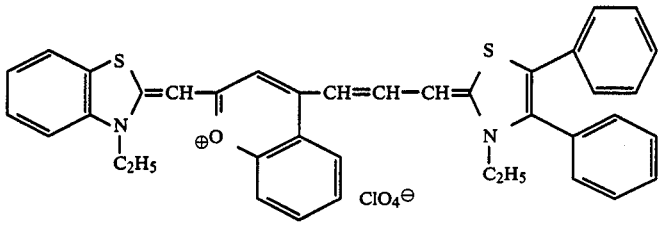
Compound 8
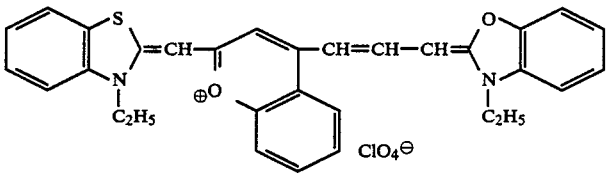
Compound 9
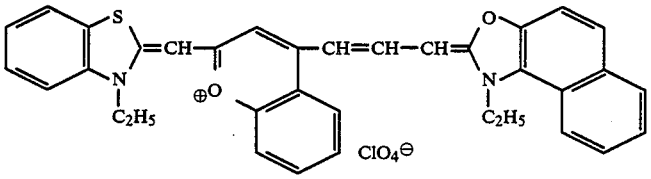
Compound 10
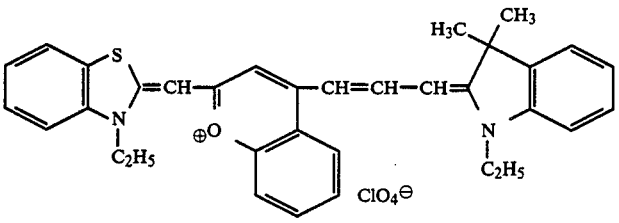
Compound 11
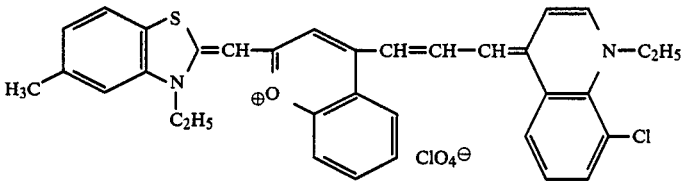
Compound 12
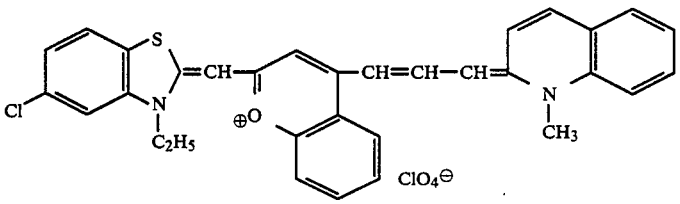
Compound 13

-continued
Compound 14
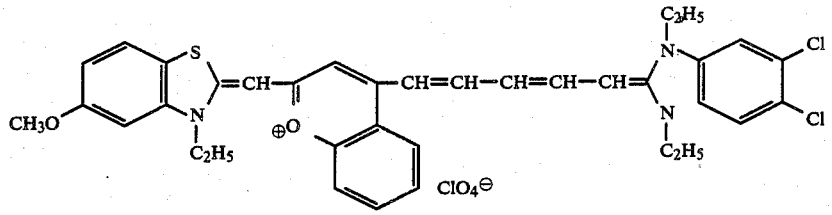
Compound 15
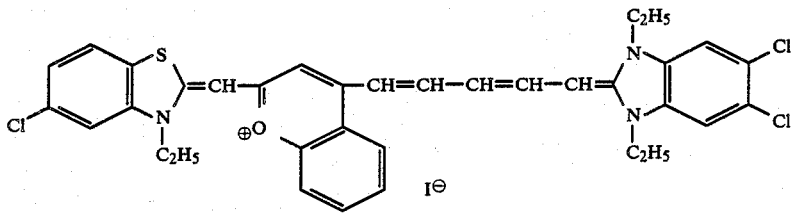
Compound 16
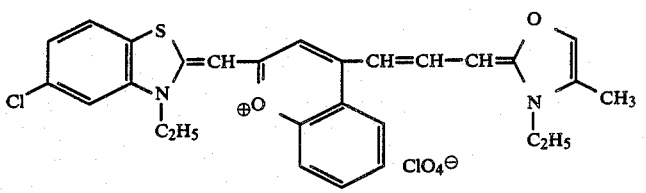
Compound 17
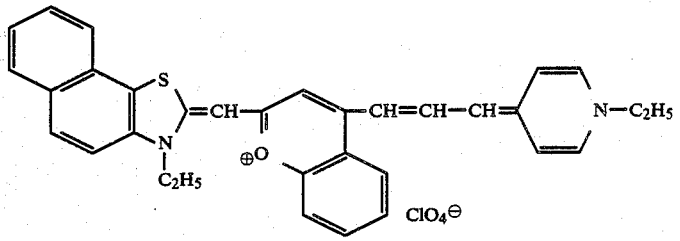
Compound 18
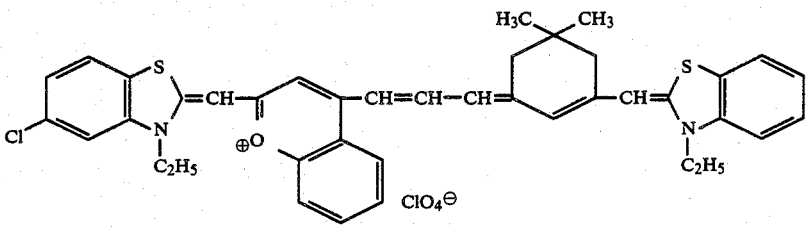
Compound 19
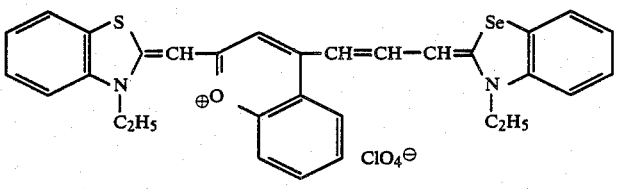
Compound 20
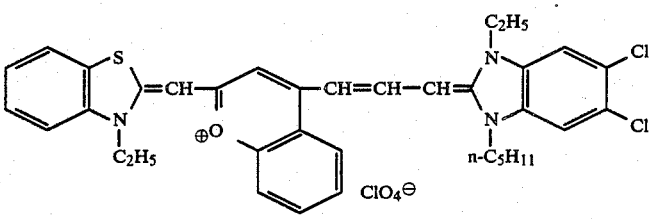

-continued
Compound 21
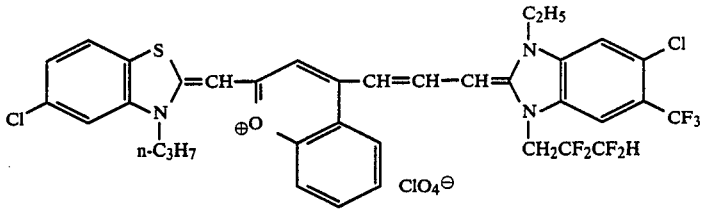
Compound 22
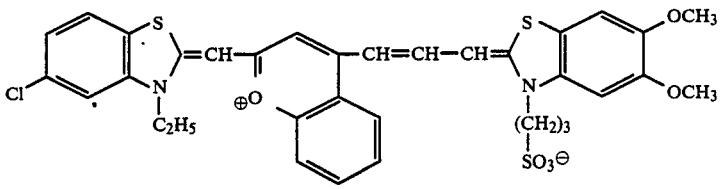
Compound 23
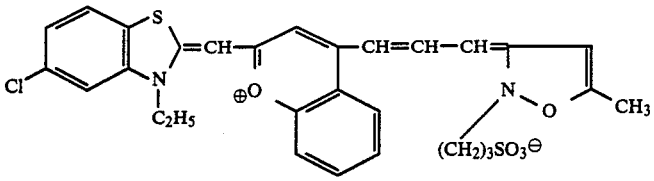
Compound 24
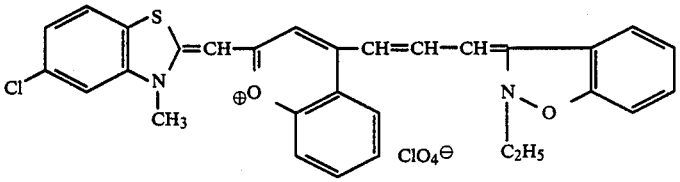
Compound 25
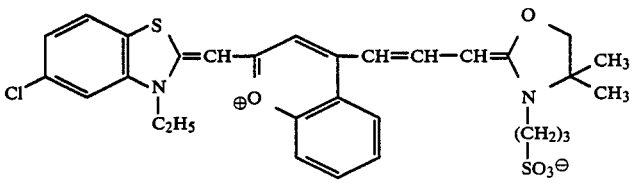
Compound 26
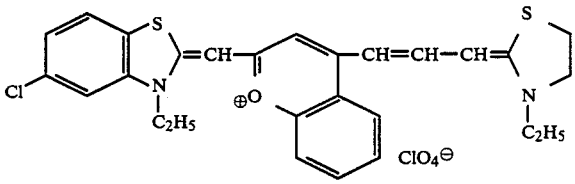
Compound 27
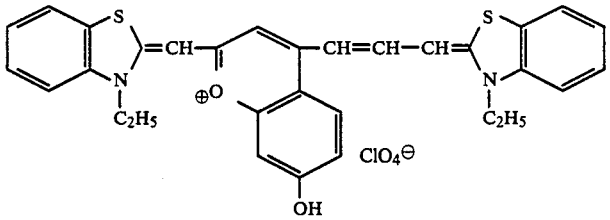

-continued
Compound 28
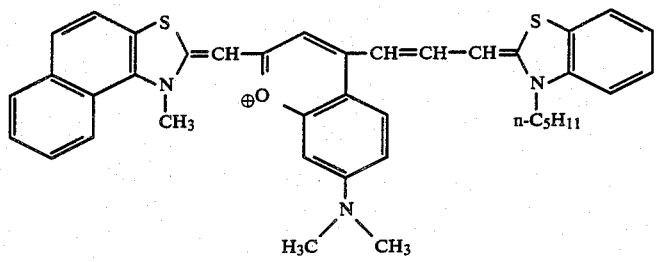
Compound 29
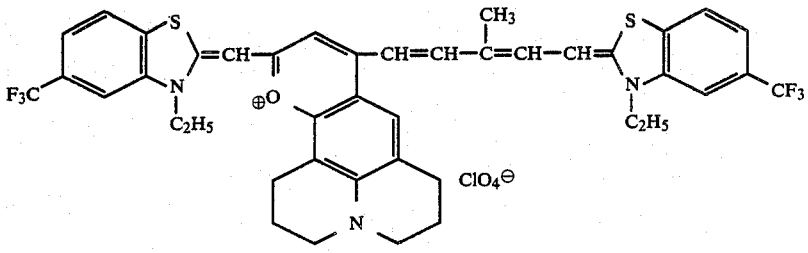
Compound 30
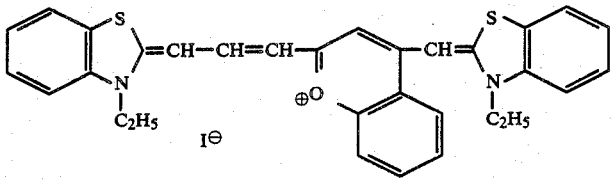
Compound 31
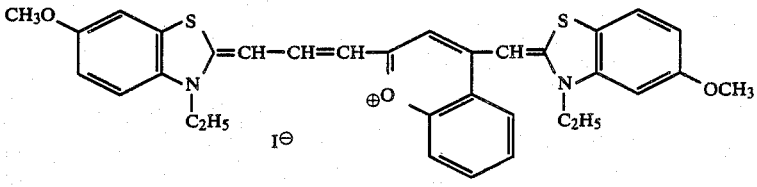
Compound 32
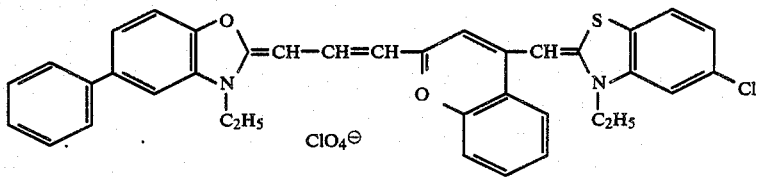
Compound 33
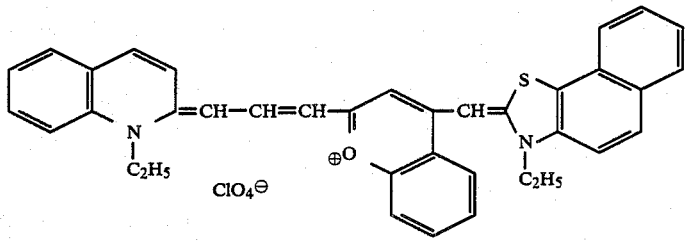
Compound 34
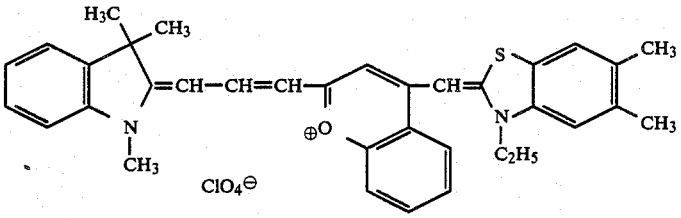

-continued
Compound 36
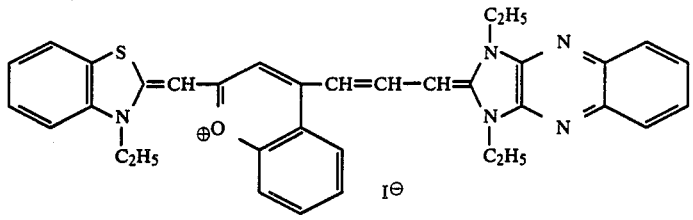
Compound 37
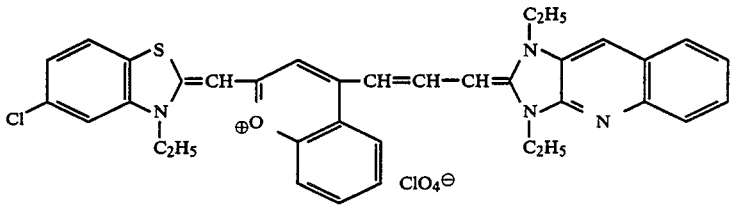
Compound 38
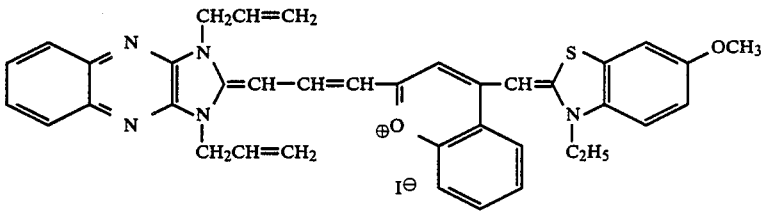
Compound 39
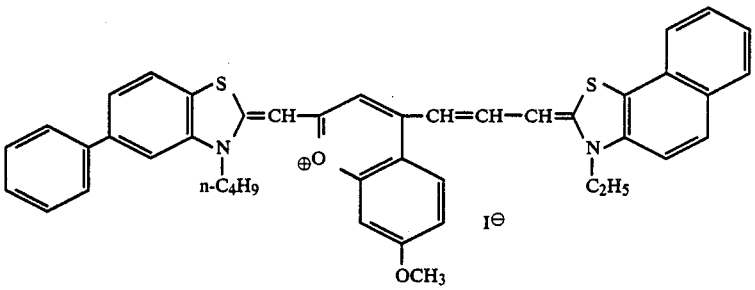
Compound 51
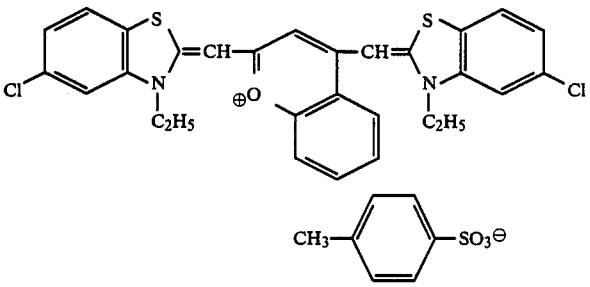
Compound 52
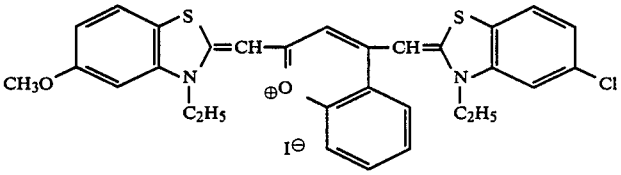

-continued
Compound 53
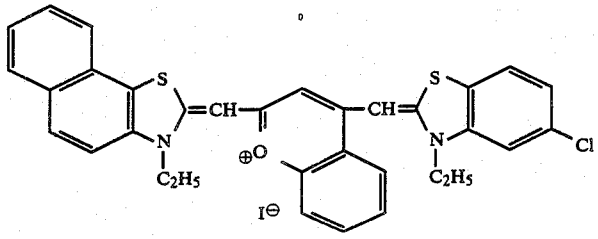
Compound 54
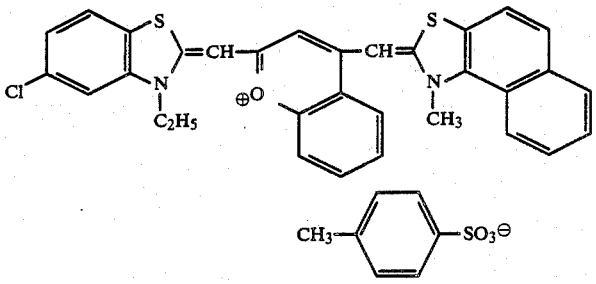
Compound 55
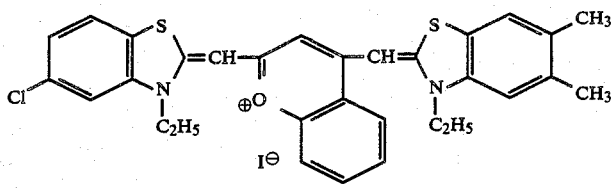
Compound 56
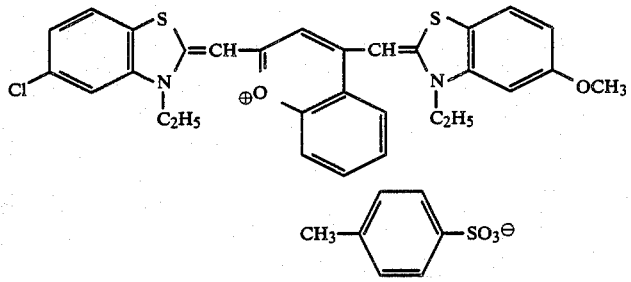
Compound 57
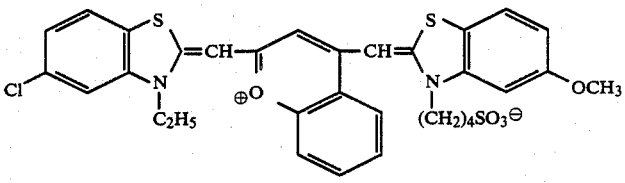
Compound 58
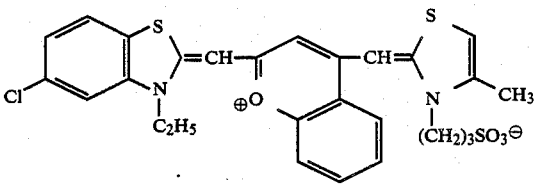
Compound 59
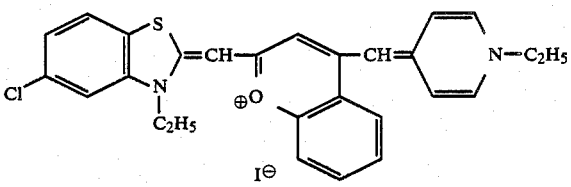

-continued
Compound 60
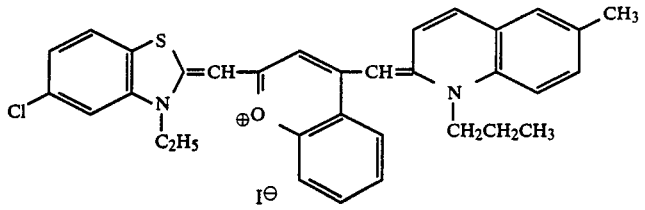
Compound 61
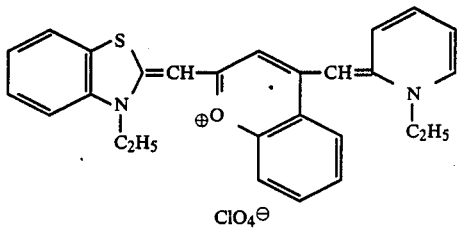
Compound 62
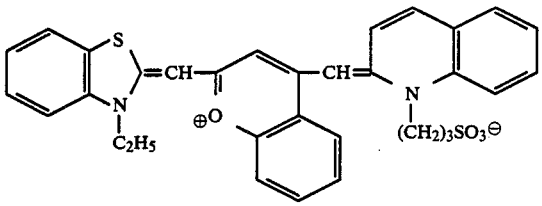
Compound 63
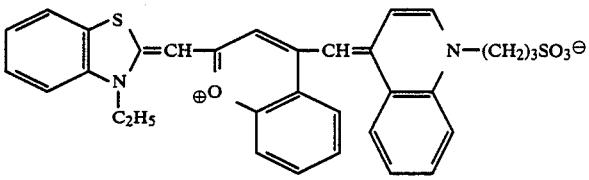
Compound 64
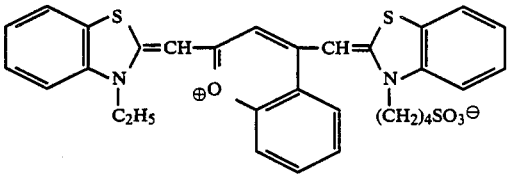
Compound 65
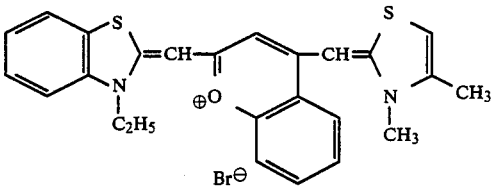
Compound 66
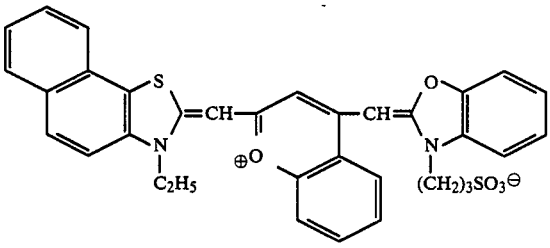

-continued
Compound 67
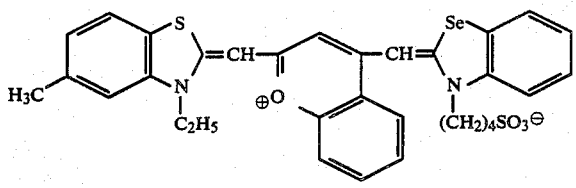
Compound 68
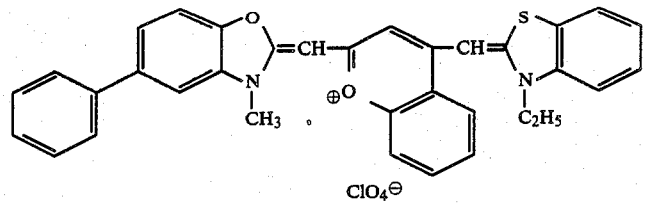
Compound 69
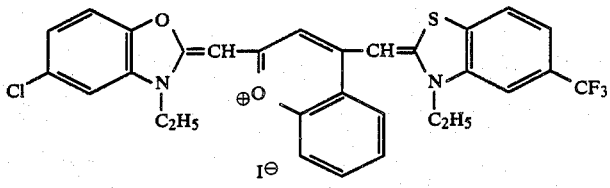
Compound 70
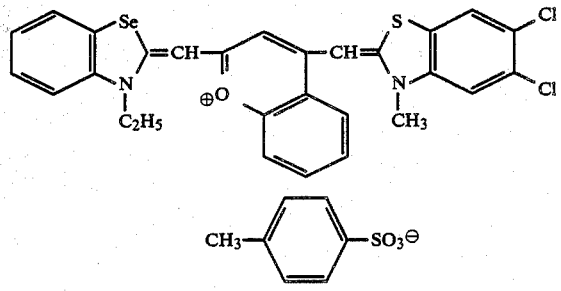
Compound 71
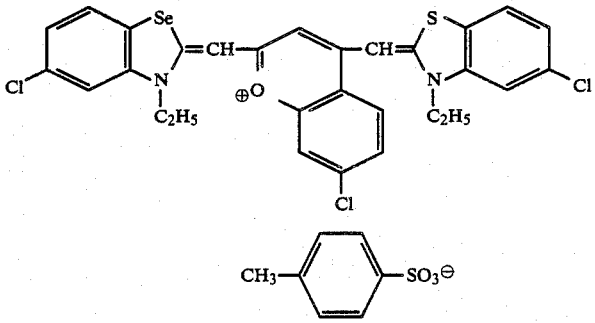
Compound 72
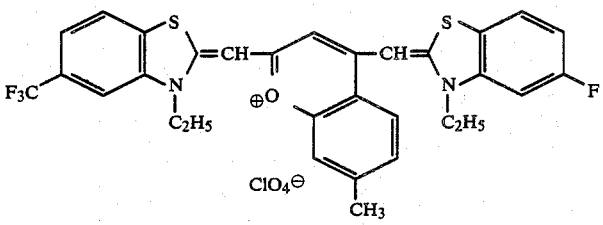

-continued
Compound 73
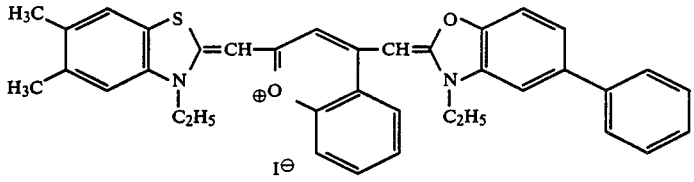
Compound 74
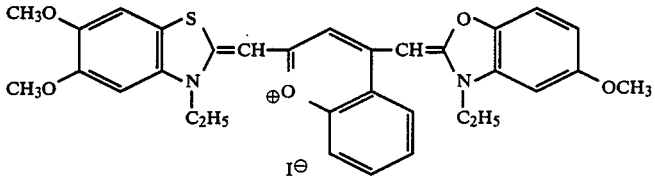
Compound 75
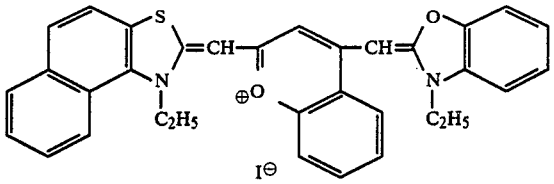
Compound 76
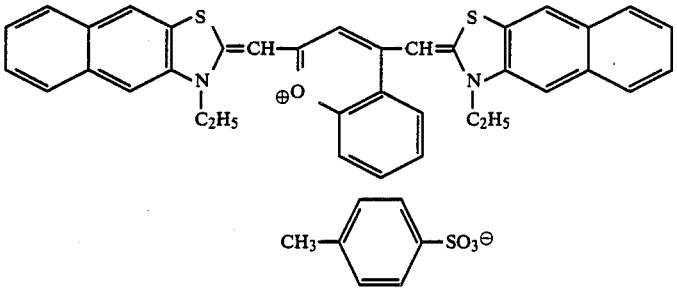
Compound 77
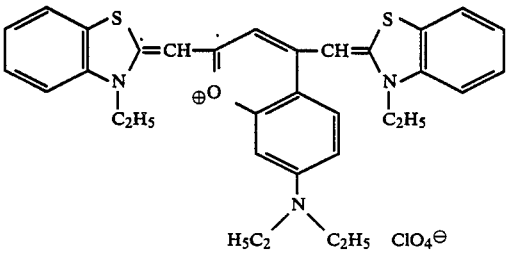
Compound 78
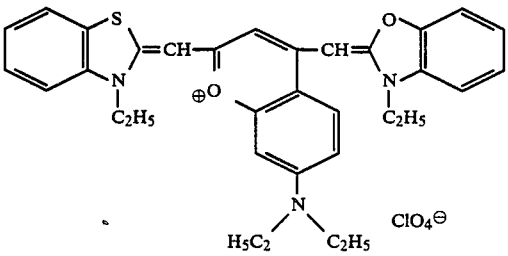

-continued

Compound 79

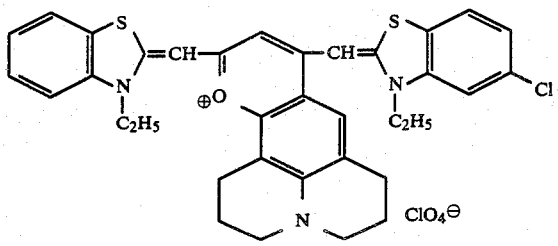

Compound 80

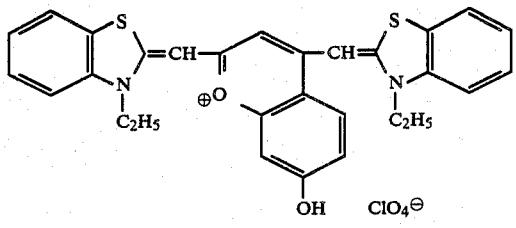

Compound 81

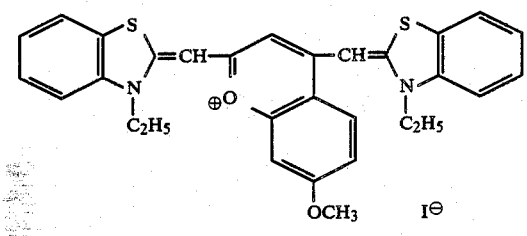

Compound 82

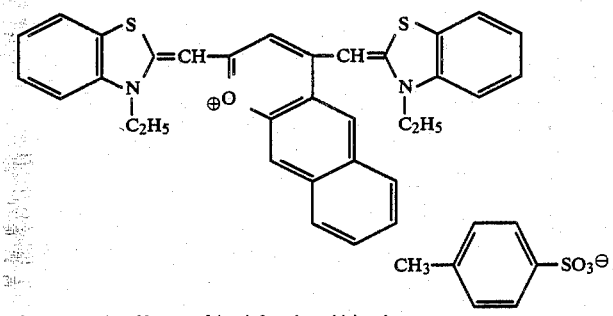

Compounds 1 to 39 are useful as infrared sensitizing dyes.

Compounds 51 to 82 are useful mainly as panchromatic sensitizing dyes.

Synthesis Examples are described hereunder, to illustrate the synthesis of some of the above listed compounds falling within the scope of formula (I) of the present invention.

SYNTHESIS EXAMPLE-1

Synthesis of the Intermediate (A)

1-(1):

3-Ethyl-2-{(4-methyl-2H-chromen-2-ylidene)methyl}-benzothiazolium perchlorate 17.5 g of 3-ethyl-2-methylbenzothiazolium-p-toluenesulfonate and 8.8 g of 4-methylcoumarin-2-thione were reacted under heat at 150° C. for 15 hours, and 20 ml of methanol and 40 ml of acetone were then added to the reaction mixture in the order listed to obtaina uniform solution. After cooling to room temperature, 15.7 g of 60%-perchloric acid was added thereto and stirred at room temperature, whereby crystals precipitated out. The crystals formed were filtered out and washed with a small amount of acetone, and thereafter the crystals were placed in a mixed solvent comprising 20 ml of methanol and 40 ml of acetone at room temperature and stirred for 30 minutes. Then the crystals were again separated by filtration and washed with acetone, to finally obtain 8.5 g of the desired perchlorate product. Yield: 40%. Appearance: brown crystal. M.p.: above 280° C. (decomposition).

1-(2):

5-Trifluoromethyl-3-ethyl-2-{(4-methyl-2H-chromen-2-ylidene)-methyl}-benzothiazolium p-toluenesulfonate 2.37 g of 5-trifluoromethyl-3-ethyl-2-methylbenzothiazolium p-toluenesulfonate and 1.0 g of 4-methylcoumarin-2-thione were reacted under heat at 150° C. for 20 hours, and then 10 ml of metrhanol, 10 ml of acetone, and 20 ml of ethyl acetate were added to the reaction mixture in the order listed to obtain a uniform solution. After cooling to room temperature, crystals precipitated out therefrom. The crystals formed were separated by filtration and washed with a small amount of acetone, and thereafter the crystlas were placed in a mixed solvent comprising 10 ml of methanol, 10 ml of acetone, and 20 ml of ethyl acetate at room temperature, and stirred for 40 minutes. Then, the crystals were again taken out by filtration and washed with acetone, at last to obtain 1.47 g of the desired p-toluenesulfonate product. Yield: 46%. Appearance: brown crystal. M.P.: 272°-273° C. (decomposition).

1-(3):
5-Chloro-3-ethyl-2-{(4-methyl-2H-chromen-2-ylidene)-methyl}-benzothiazolium p-toluenesulfonate 11.1 g of 5-chloro-3-ethyl-2-methylbenzothiazolium p-toluenesulfonate and 5.5 g of 4-methylcoumarin-2-thione were reacted under heat at 150° C. for 23 hours, and then 25 ml of methanol, 50 ml of acetone and 150 ml of ethyl acetate were added to the reaction mixture in the order listed. After cooling to room temperature, crystals precipitated out from the reaction solution, and the crystals were separated by filtration and washed with a small amount of acetone. Afterwards, the crystals were placed in a mixed solvent comprising 25 ml of methanol, 50 ml of acetone, and 150 ml of ethyl acetate at room temperature, and stirred for 20 minutes, and then the crystals was again separated by filtration and washed with acetone, to finally obtain 7.9 g of the desired p-toluenesulfonate product. Yield: 52%. Appearance: brown crystal. M.p.: 282°-283° C. (decomposition).

1-(4):
5-Methyl-3-ethyl-2-{(4-methyl-2H-chromen-2-ylidene)-methyl}bemzothiazolium perchlorate 2.07 g of 5-methyl-3-ethyl-2-methylbenzothiazolium p-toluenesulfonate and 1.0 g of 4-methylcoumarin-2-thione were reacted under heat at 150° C. for 25 hours, and then 10 ml of methanol, 10 ml of acetone, and 20 ml of ethyl acetate were added to the reaction mixture in the order listed. After cooling to room temperature, crystals precipitated out from the reaction solution, and the crystals formed were separated by filtration and washed with a small amount of acetone, and thereafter 20 ml of methanol and 40 ml of acetone were added thereto in the order listed, to obtain a uniform solution. Next, 5 g of 60%-perchloric acid was added thereto and stirred for 30 minutes at room temperature, and the precipitated crystals were again separated by filtration and washed with acetone, to obtain 1.46 g of the desired perchlorate product. Yield: 55%. Appearance: brown crystal. M.p.: 270°-275° C. (decomposition).

1-(5):
5-Methoxy-3-ethyl-2-{(4-methyl-2H-chromen-2-ylidene)-methyl}benzothiazolium iodide 2.15 g of 5-methoxy-3-ethyl-2-methylbenzothiazolium p-toluenesulfonate and 1.0 g of 4-methylcoumarin-2-thione were reacted under heat at 150° C. for 20 hours, and then 15 ml of methanol and 12 ml of acetone were added to the reaction mixture to obtain a uniform solution. 1.7 g of sodium iodide (in the form of a solution in 5 ml of acetone) was added dropwise to said solution and stirred at room temperature, whereby crystals precipitated out therefrom. The crystals formed were separated by filtration and washed with a small amount of acetone, and then the crystals were placed in 20 ml of water at room temperature and stirred for 15 minutes. Then, the crystals were again separated by filtration and washed with acetone, to obtain 1.02 g of the desired iodide product. Yield: 38%. Appearance: brown crystal. M.p.: 273°-274° C. (decomposition).

1-(6):
3-Ethyl-2-{(4-methyl-2H-chromen-2-ylidene)methyl}-naphtho[2,1-d]thiazolium ioidide 2.27 g of 3-ethyl-2-methylnaphtho[2,1-d]thiazolium iodide and 1.0 g of 4-methylcoumarin-2-thione were reacted under heat at 150° C. for 21 hours, and then 8 ml of methanol and 12 ml of acetone were added to the reaction mixture in the order listed to obtain a uniform solution. Next, 1.7 g of sodium iodide (in the form of an aqueous solution in 5 ml of water) was added dropwise to the resultant solution and stirred for 1 hour at room temperature, whereby crystals precipitated out therefrom. The crystals formed were separated by filtration and washed with a small amount of acetone, and thereafter said crystals were placed in a mixed solvent comprising 15 ml of water and 15 ml of acetone at room temperature and stirred for 15 minutes. Then, the crystals were again separated by filtration and washed with acetone, to finally obtain 0.8 g of the desired iodide product. Yield: 28%. Appearance: brown crystal. M.p.: above 280° C. (decomposition).

1-(7):
3-Ethyl-2-{(4-methyl-2H-chromen-2-ylidene)methyl}-naphtho[1,2-d]thiazolium iodide From 2.27 g of 3-ethyl-2-methylnaphtho[1,2-d]thioazolium iodide and 1.0 g of 4-methylcoumarin-2-thione 0.08 g of the desired iodide product was obtained in the same manner as in synthesis 1-(6) above. Yield: 3.5%. Appearance: brown crystal. M.p.: 140°-142° C. (decomposition).

SYNTHESIS EXAMPLE-2

Synthesis of Compound No. 1

2-[(3-ethyl-2(3H)-benzothiazolinylidene)methyl]-4-[3-(3-ethyl-2(3H)-benzothiazolinylidene)propenyl]-5,6-benzopyrylium perchlorate 2.8 g of 3-ethyl-2-{(4-methyl-2H-chromen-2-ylidene)-methyl}-benzothiazoliium perchlorate and 3.0 g of 2-(2-acetanilido-vinyl)-3-ethylbenzothiazolium iodide were added to 150 ml of ethanol and heated under reflux, and then 6 ml of triethylamine was added thereto. After reacting for 15 minutes, the reaction mixture was cooled to room temperature, and the crystals formed were separated by filtration. The crude crystals obtained were purified by means of silica gel-column chromatography (developer: methanol/chloroform=$\frac{1}{8}$ (by volume)) and then recrystallized from a mixed solvent of methanol/chloroform (2/8) twice, to obtain 1.7 g of the above-entitled product. Yield: 43%. Appearance: Dark brilliant brown crystal. M.p.: 260°-262° C. (decomposition).

$\lambda_{max}^{methanol}$: 730 nm, $\epsilon_{max}^{methanol}$: $2.08 \times 10^5$.

SYNTHESIS EXAMPLE-3

Synthesis of Compound No. 2

2-[(3-ethyl-2(3H)-benzothiazolinylidene)methyl]-4-[3-(3-ethylnaphtho[1,2-d]-thiazolinilydene)-propenyl]-5,6-benzopyrylium perchlorate 3.0 g of 3-ethyl-2-{(4-methyl-2H-chromen-2-yllidene)methyl}benzothiazolium perchlorate and 3.9 g of 2-(2-acetanilidovinyl)-3-ethylnaphtho[1,2-d]thiazolium p-toluenesulfonate were added to 150 ml of ethanol and heated under reflux, and then 6 ml of triethylamine was added thereto. After reacting for 15 minutes, the reaction mixture was cooled to room temperature, and the crystals formed were separated by filtration therefrom. The crude crystals obtained were purified by means of silicagel column chromatography (developer: methanol/chloroform=2/8), and then recrystallized from a mixed solvent of methanol/chloroform (2/8 by volume) twice, to obtain 1.8 g of the desired parchlorate product. Yield: 38%. Appearance: Brilliant brown crystal. M.p.: 275°–278° C. (decomposition).

$\lambda_{max}^{methanol}$: 752 nm, $\epsilon_{max}^{methanol}$: $2.05 \times 10^5$.

SYNTHESIS EXAMPLE-4

Synthesis of Compound No. 7

2-[(3-ethyl-2(3H)-benzothiazolinylidene)methyl]-4-[5-(3-ethyl-5,6-dimethyl-2(3H)-benzo-thiazolinylidene)-3-methyl-1,3-pentadienyl]-5,6-benzopyrylium perchlorate 3.5 g of 3-ethyl-2-{(4-methyl-2H-chromen-2-ylidene)-methyl}benzothiazolium p-toluenesulfonate and 3.1 g of 2-(4-ethoxy-3-methyl-1,3-butadienyl)-3-ethyl-5,6-dimethylbenzothiazolium iodide were added to 150 ml of ethanol and heated under reflux, and then, 6 ml of triethylamine was added thereto. After reacting for 12 minutes, the reaction mixture was cooled to room temperature and the crystals formed were separated by filtration therefrom. The crude crystals obtained were purified by means of silicagel-column chromatogrpahy (developer: methanol/chloroform=2/8), and the thus purified crystal was dissolved in 500 ml of methanol and a solution of 1.8 g of sodium perchlorate dissolved in 100 ml of water was added thereto. The precipitated crystals were separated by filtration and recrystallized from a mixture solvent of methanol/chloroform twice, to finally obtain 2.7 g of the desired perchlorate product. Yield: 56%. Appearance: Brilliant brown crystal. M.p.: 200°–202° C. (decomposition).

$\lambda_{max}^{methanol}$: 835 nm. $\epsilon_{max}^{methanol}$: $2.17 \times 10^5$.

SYNTHESIS EXAMPLE-5

Synthesis of Compound No. 9

2-[(3-ethyl-2(3H)-benzothiazolinylidene)methyl]-4-[3-(3-ethyl-2(3H)-benzoxazolinylidene)propenyl]-5,6-benzopyrylium perchlorate 3.0 g of 3-ethyl-2-{(4-methyl-2H-chromen-2-ylidene)-methyl}benzothiazolium perchlorate, 3.1 g of 2-(2-anilinovinyl)-3-ethylbenzoxazolium ethanesulfate, and 5 ml of acetic anhydride were added to 100 ml of DMF and heated at 100° C. for 5 minutes, and thereafter 6 ml of triethylamine was added thereto and further reacted under heat for 5 minutes. After cooling to room temperature, the precipitated crystals were separated by filtration from the reaction solution, and the crude crystals obtained were recrystallized twice from a mixture solvent of methanol/chloroform, to finally obtain 2.6 g of the above-entitled product. Yield: 62%. Appearance: Dark green crystal. M.p.: 268°–270° C. (decomposition).

$\lambda_{max}^{methanol}$: 694 nm.

SYNTHESIS EXAMPLE-6

The following compounds were obtained, in an analogous manner to that of above Synthesis Example 1 through 5.

| Compound No. | Appearance | Yield | M.p. (decomposition temp.) | methanol λmax |
|---|---|---|---|---|
| Compound No. 5 | Dark green crystal | 52% | 186–189° C. | 828 nm |
| Compound No. 8 | Dark blue crystal | 47 | 178–181 | 748 |
| Compound No. 10 | Red-brown crystal | 59 | 180–181 | 707 |
| Compound No. 11 | Black crystal | 53 | 157–159 | 707 |
| Compound No. 13 | Dark green crystal | 51 | 272–275 | 748 |
| Compound No. 19 | Black crystal | 41 | 191–193 | 733 |

SYNTHESIS EXAMPLE-7

The following compounds were obtained, in an alalogous manner to that of above Synthesis Examples 1 through 5.

| Compound No. | Appearance | Yield | methanol max |
|---|---|---|---|
| Compound No. 3 | Dark green crystal | 52% | 710 nm |
| Compound No. 4 | Dark green crystal | 41 | 824 |
| Compound No. 6 | Dark green crystal | 39 | 830 |
| Compound No. 12 | Brilliant brown crystal | 32 | 815 |
| Compound No. 14 | Dark green crystal | 40 | 804 |
| Compound No. 15 | Dark green crystal | 43 | 850 |
| Compound No. 16 | Brown crystal | 55 | 668 |
| Compound No. 17 | Dark green crystal | 39 | 734 |
| Compound No. 18 | Brown crystal | 22 | 937 |
| Compound No. 20 | Dark green crystal | 56 | 698 |
| Compound No. 21 | Dark green crystal | 58 | 705 |
| Compound No. 22 | Dark green crystal | 38 | 752 |
| Compound No. 23 | Dark green crystal | 18 | 648 |
| Compound No. 24 | Brilliant brown crystal | 32 | 693 |
| Compound No. 25 | Dark green crystal | 41 | 649 |
| Compound No. 26 | Brilliant brown crystal | 44 | 676 |

SYNTHESIS EXAMPLE-8

Syntehsis of Compound No. 51

2,4-Bis[(5-chloro-3-ethyl-2-benzothiazolinylidene)methyl]-5,6-benzopyrylium p-toluenesulfonate 5.2 g of 5-chloro-3-ethyl-2-{(4-methyl-2H-chromen-2-ylidene)methyl}-benzothiazolium p-toluenesulfonate and 4.3 g of 5-chloro-3-ethyl-2-ethylthiobenzothiazolium p-toluenesulfonate were added to 140 ml of acetonitrile and dissolved under heat, and then 4.5 ml of triethylamine was added thereto and reacted for 5 minutes. After cooling the precipitated crystals were separated by filtration and recrystallized from a mixed solvent of methanol/chloroform, to obtain 3.6 g of the desired p-toluenesulfonate product. Yield: 50%. Appearance: Brilliant brown crystal. M.p.: above 240° C. (decomposition).

$\lambda_{max}^{methanol}$: 605 nm $\epsilon_{max}^{methanol}$: $1.70 \times 10^5$.

SYNTHESIS EXAMPLE-9

Synthesis of Compound No. 52

2-[(3-ethyl-5-methoxy-2-benzothiazolinylidene)methyl]-4-[(5-chloro-3-ethyl-2-benzothiazolinylidene)methyl]-5,6-benzopyrylium iodide 5.0 g of 3-ethyl-5-methoxy-2-{(4-methyl-2H-chromen-3-ylidene)methyl}-benzothiazolium iodide (5.0 g) and 4.3 g of 5-chloro-3-ethyl-2-ethylthiobenzothiazolium p-toluenesulfonate were reacted in an analogous manner as in the above Synthesis Example-2, to obtain 3.5 g of the desired iodide product. Appearance: Dark green crystal. M.p.: above 234° C. (decomposition).

$\lambda_{max}^{methanol}$: 611 nm.

SYNTHESIS EXAMPLE-10

Synthesis of Compound No. 53

2-[(3-ethylnaphtho 2,1-d thiazolinylidene)methyl]-4-[(5-chloro-3-ethyl-2-benzothiazolinylidene)-methyl]-5,6-benzopyrylium perchlorate 5.1 g of 3-ethyl-2-{(4-methyl-2H-chromen-2-ylidene)-methyl}naphtho[2,1-d]thiazolium iodide and 4.3 g of 5-chloro-3-ethyl-2-ethylthiobenzothiazolium p-toluenesulfonate were reacted in the same manner as in the above Synthesis Example-2, and the resultant product was subjected to salt-interchange with sodium perchlorate, to obtain 2.0 g of the desired perchlorate product. Apperance: Dark green crystal. M.p.: above 280° C. (decomposition).

$\lambda_{max}^{methanol}$: 620 nm

SYNTHESIS EXAMPLE-11

Synthesis of Compounds Nos. 54–67

The following compounds were obtained, in an analaogous manner to that of the above Synthesis Example-2.

| Compound No. | Appearance | methanol max |
|---|---|---|
| 54 | Dark green | 616 nm |
| 55 | Brown | 606 |
| 56 | Brown | 608 |
| 57 | Brown | 609 |
| 58 | Dark green | 595 |
| 59 | Dark green | 610 |
| 60 | Dark green | 650 |
| 61 | Dark green | 592 |
| 62 | Dark green | 652 |
| 63 | Dark green | 685 |
| 64 | Dark green | 602 |
| 65 | Dark green | 592 |
| 66 | Brown | 597 |
| 67 | Dark green | 609 |

These sensitizing dyes of the present invention may be used singly or may be used in combinations thereof. In addition, the emulsion used in the photographic material of the present invention may contain a dye which does not itself have any spectral-sensitization activity or a substance which does not substantially absorb any visible radiation, but which does have supersensitization activity, together with the sensitizing dye represented by formlua (I). For instance, a nitrogen-containing heterocyclic group-substituted aminostilbene compound (e.g., as described in U.S. Pat. Nos. 2,933,390 and 3,635,721), an aromatic organic acid/formaldehyde condensation product (e.g., as described in U.S. Pat. No. 3,743,510), a cadmium salt, an azaindene compound, etc., may be used together with the sensitizing dye of formula (I). The combinations as described in U.S. Pat. Nos. 3,615,613, 3,615,641, 3,617,295, and 3,635,721 are especially preferred.

The amount of the sensitizing dye of the present invention to be used in an emulsion is from $10^{-8}$ to $10^{-2}$ mole, and preferably from $10^{-7}$ to $10^{-4}$ mole, per mole of a silver halide in said emulsion.

The sensitizing dye to be used in the present invention may be directly dispersed in the emulsion. Otherwise, said sensitizing dye is first dissolved in a solvent such as methyl alcohol, ethyl alcohol, methyl cellosolve, acetone, water, pyridine, or a mixed solvent thereof, and the resultant solution may then be added to the emulsion. In some cases, ultrasonic waves may be applied for dissolving the dye. For the addition of said infrared sensitizing dye, various conventional means may be utilized, including a method wherein a dye is dissolved in a volatile organic solvent and the resultant solution is dispersed in a hydrophilic colloid and the dispersion formed thereby is added to an emulsion, as described in U.S. Pat. No. 3,469,987; a method wherein a water-insoluble dye is, without being dissolved, dispersed in a water-soluble solvent and the resultant dispersion is added to an emulsion, as described in Japanese Patent Publication No. 24185/71; a method wherein a dye is dissolved in a surfactant solution and the resultant solution is added to an emulsion, as described in U.S. Pat. No. 3,822,135; a method where a dye is dissolved using a red-shifting compound and the resultant solution is added to an emulsion, as described in Japanese Patent Application (OPI) No. 74624/76; and a method wherein a dye is dissolved in a substantially water-free acid and the resultant solution is added to an emulsion, as described in Japanese Patent Application (OPI) No. 80826/75. In addition, various known techniques as described in U.S. Pat. Nos. 2,912,343, 3,342,605, 2,996,287, 3,429,835, etc., may be applied to the addition of the sensitizing dye to a photographic emulsion. In this connection, the sensitizing dye may be uniformly dispersed in a silver halide emulsion, before being coated on a pertinent support, and it is of course convenient that said dye may be added to said silver halide emulsion in any step of the preparation of said emulsion. For instance, said dye may be incorporated during the formation of said silver halide particles, or otherwise may be incorporated during the after-ripening of said emulsion.

The photographic material of the present invention may also have, if desired, one or more layers having a photo-sensitivity in any spectral range other than an infrared- or red-spectral range, in addition to the infrared- or red-sensitive layer.

Sensitizing dyes which are useful for said purpose are described, for example, in German Pat. No. 929,080; U.S. Pat. Nos. 2,493,748, 2,503,776, 2,519,001, 2,912,329, 3,656,959, 3,672,897, 3,694,217, 4,025,349 and 4,046,572; British Pat. No. 1,242,588; Japanese Patent Publication Nos. 14030/69 and 24844/77.

These sensitizing dyes may be used singly or may be used in the form of a mixture thereof. In particular, combination of the sensitizing dyes is often used for the purpose of super-sensitization. Examples thereof are scribed, for example, in U.S. Pat. Nos. 2,688,545, 2,977,229, 3,397,060, 3,522,052, 3,527,641, 3,617,293, 3,628,964, 3,666,480, 3,672,989, 3,679,428, 3,703,377, 3,814,609, 3,837,862, and 4,026,707; British Pat. Nos. 1,344,181 and 1,507,803; Japanese Patent Publication No. 4936/68 and No. 12375/78 and Japanese Patent Application (OPI) No. 110618/77 and No. 109925/77.

The sensitizing dye of the present invention is especially effective when used together with a base or a base precursor.

Examples of preferred bases which may be used in the present invention are inorganic bases such as alkali metal or alkaline earth metal hydroxides, secondary or tertiary phosphates, borates, carbonates, metaborates; ammonium hydroxiees; and other metal hydroxiees; and organic bases such as quaternary alkylammonium hydroxides; quinolinates; aliphatic amines (e.g., trialkylamines, hydroxylamines, aliphatic polyamines); aromatic amines (e.g., N-alkyl-substituted aromatic amines, N-hydroxylalkyl-substituted aromatic amines and bis p-(dialkylamino)phenyl methanes); heterocyclic amines, amidines, cyclic amidines, guanidines, cyclic guanidines, etc. Amoung them those having a pKa value of 8 or more are especially preferred.

As a base precursor, those capable of releasing a base through some reaction under heat are preferably used, including a salt of an organic acid and a base capable of decarboxylating and decomposing under heat or a compound capable of decomposing and releasing an amine due to intramolecular nucleophilic substitution-reaction, Lossen rearrangement, Beckmann rearrangement or the like reaction. Examples of preferred base precursors are salts of trichloro-acetic acid, as described in British Pat. No. 998,949; salts of α-sulfonylacetic acid, as described in U.S. Pat. No. 4,060,420; salts of propiolic acids, as described in Japanese Patent Application (OPI) No. 180537/84; 2-carboxy-carboxamide derivatives, as described in U.S. Pat. No. 4,088,496; salts of pyrolytic acids, in which as alkali metal or alkaline earth metal component is used besides an organic base, as a base component, as described in Japanese Patent Application (OPI) No. 195237/84; hydroxamecarbamates as described in Japanese Patent Application (OPI) No. 168440/84, in which a Lossen rearrangement is utilized; aldoxime-carbamates capable of forming a nitrile under heat, as decribed in Japanese Patent Application (OPI) No. 157637/84, etc. In addition, other base precursors as described in British Pat. No. 998,945, U.S. Pat. No. 3,220,846, Japanese Patent Application (OPI) No. 22,625/74 and British Pat. No. 2,079,480 are also useful.

Particularly useful base precursors which are especially preferred in the present invention are guanidine trichloro-acetate, methylguanidine trichloro-acetate, potassium trichloro-acetate, guanidine phenylsulfonyl-acetate, guanidine p-chlorophenylsulfonyl-acetate, guanidine p-methanesulfonylphenylsulfonyl-acetate, potassium phenyl-propiolate, cesium phenylpropiolate, guanidine phenyl-propiolate, guanidine p-chlorophenyl-propiolate, guanidine 2,4-dichlorophenyl-propiolate, diquanidine p-phenylene-bis-propiolate, tetrametylammonium phenylsulfonyl-acetate, tetramethylammonium phenyl-propiolate, etc.

The range of the amount of said base or base precursor to be used may be wide. The useful range thereof is not more than 50 wt% on the baisi of the total weight of a coated and dried layer(s) of a photographic material, and more preferably is from 0.01 wt% to 40 wt%.

It is of course possible to use said base or base precursor not only for the purpose of acceleration of dye-release but also for other purposes such as pH-regulation, etc.

The base or base precursor may be incorporated in any photographic layer of the photographic material of the present invention. For example, it may be included in a silver halide emulsion layer, an interlayer, a protective layer, an image receiving layer, etc.

According to the present invention, silver can be utilized as an image forming substance. Further, various other image forming substances can be employed in various image forming processes.

For instance, couplers capable of forming color images upon reaction with an oxidation product of a developing agent which are used in liquid development processing widely known hitherto can be employed. For example, as magenta couplers, there are 5-pyrazolone couplers, pyrazolobenzimidazole couplers, cyanoacetylcoumarone couplers and open chain acylacetonitrile couplers, etc. As yellow couplers, there are acylacetamide couplers (for example, benzoylacetanilides and pivaloyl-acetanilides), etc. As cyan couplers, there are naphthol couplers and phenol couplers, etc. It is preferred that these couplers be nondiffusible substances which have a hydrophobic group called a ballast group in the molecule thereof or be polymerized substances. The couplers may be any of the 4-equivalent type and 2-equivalent type to silver ions. Further, they may be colored couplers having a color correction effect or couplers which release a development inhibitor at development processing (so-called DIR couplers).

Further, dyes for forming positive color images by a light-sensitive silver dye bleach processes, for example, those as described in *Research Disclosure,* RD No. 14433 (April, 1976), pp. 30–32, ibid., RD No. 15227 (December, 1976), pp. 14–15, and U.S. Pat. No. 4,235,957, etc., can be employed.

Moreover, leuco dyes as described, for example, in U.S. Pat. Nos. 3,985,565 and 4,022,617, etc., can be used.

Further, dyes to which a nitrogen-containing heterocyclic group have been introduced as described in *Research Disclosure,* RD No. 16966 (May, 1978), pp. 54–58, may be employed.

In addition, dye providing substances which release a mobile dye by utilizing a coupling reaction of a reducing agent oxidized by an oxidation reduction reaction with a silver halide or an organic silver salt at high temperature as described in European Pat. No. 79,056, West German Pat. No. 3,217,853, European Pat. No. 67,455, etc., and dye providing substances which release a mobile dye as a result of an oxidation reduction reaction with a silver halide or an organic silver salt at high temperature as described in European Pat. No. 76,942, West German Pat. No. 3,215,485, European Pat. No. 66,282, Japanese Patent Application (OPI) No. 154,445/84 and U.S. Pat. No. 4,503,137, etc., can be employed.

Preferred dye providing substances which can be employed in these processes can be represented by formula (CI)

$$(\text{Dye}-X)_q Y \qquad \text{(CI)}$$

wherein Dye represents a dye which becomes mobile when it is released from the molecule of the compound represented by formula (CI); X represents a chemical bond or a linking group; Y represents a group which releases Dye in correspondence or counter-correspondence to light-sensitive silver salts having a latent image distributed imagewise, the diffusibility of Dye released being different from that of the compound represented by formula (CI), q represents an integer of 1 or 2, and when q is 2, the two (Dye-X) are the same or different.

The dye represented by Dye is preferably a dye having a hydrophilic group. Examples of the dye which can be used include azo dyes, azomethane dyes, anthraquinone dyes, naphthoquinone dyes, styryl dyes, nitro dyes, quinoline dyes, carbonyl dyes, and phthalocyanine dyes, etc. These dyes can also be used in the form of having temporarily shorter wavelengths, the color of which is recoverable in the development processing.

More specifically, the dyes as described in European Pat. No. 76,492 can be utilized.

Examples of the connecting group represented by X include —NR— (wherein R represents a hydrogen atom, an alkyl group, or a substituted alkyl group), $—SO_2—$, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

In the following, preferred embodiments of Y in formula (CI) are described in greater detail.

In one embodiment, Y is selected so that the compound represented by formula (CI) is a nondiffusible image forming compound which is oxidized as a result of development, thereby undergoing self-cleavage and releasing a diffusible dye.

An example of Y which is effective for compounds of this type is an N-substituted sulfamoyl group. For example, a group represented by formula (CII) is illustrated for Y.

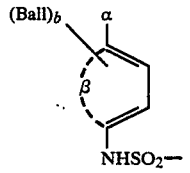

(CII)

wherein β represents non-metallic atoms necessary for forming a benzene ring, which may optionally be fused with a carbocyclic ring or a heterocyclic ring to form, for example, a naphthalene ring, a quinoline ring, a 5,6,7,8-tetrahydronaphthalene ring, chroman ring or the like;

α represents a group of $—OG^{11}$ or $—NHG^{12}$ (wherein $G^{11}$ represents hydrogen or a group which forms a hydroxyl group upon being hydrolyzed, and $G^{12}$ represents hydrogen, an alkyl group containing from 1 to 22 carbon atoms or a hydrolyzable group);

Ball represents a ballast group; and b represents an integer of 0, 1 or 2.

Specific examples of this type of Y are described in Japanese Patent Application (OPI) Nos. 33826/73 and 50736/78.

Other examples of Y suited for this type of compound are those represented by formula (CIII)

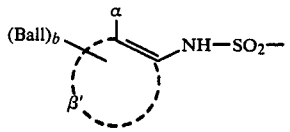

(CIII)

wherein Ball, α and b are the same as defined in formula (CII), β' represents atoms necessary for forming a carbocyclic ring (e.g., a benzene ring which may be fused with another carbocyclic ring or a heterocyclic ring to form, e.g., a naphthalene ring, a quinoline ring, a 5,6,7,8-tetrahydronaphthalene ring, a chroman ring, or the like). Specific examples of this type of Y are described in Japanese Patent Application (OPI) Nos. 113624/76, 12642/81, 16130/81, 4043/82 and 650/82 and U.S. Pat. No. 4,053,312.

Further examples of Y suited for this type of compound are those represented by formula (CIV)

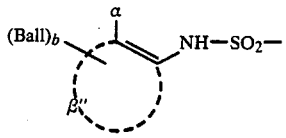

(CIV)

wherein Ball, α and b are the same as defined in formula (CII), and β'' represents atoms necessary for forming a heterocyclic ring such as a pyrazole ring, a pyridine ring or the like, said heterocyclic ring being optionally bound to a carbocyclic ring or a heterocyclic ring. Specific examples of this type of Y are described in Japanese Patent Application (OPI) No. 104343/76.

Still further examples of Y suited for this type of compound are those represented by formula (CV)

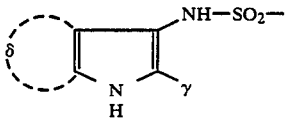

(CV)

wherein γ preferably represents hydrogen, a substituted or unsubstituted alkyl, aryl or heterocyclic group, or $—CO—G^{21}$; $G^{21}$ represents $—OG^{22}$, $—SG^{22}$ or

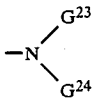

wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen or an unsubstituted or substituted alkyl group); and δ represents a residue necessary for completing a fused benzene ring.

Specific examples of this type of Y are described in Japanese Patent Application (CPI) Nos. 104343/76, 46730/78, 130122/79 and 85055/82.

Still further examples of Y suited for this type of compound are those represented by formula (CVI)

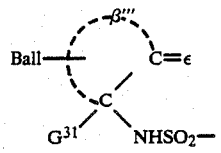

(CVI)

wherein Ball is the same as defined in formula (CII); $\epsilon$ represents an oxygen atom or $=NG^{32}$ (wherein $G^{32}$ represents hydroxyl or an optionally substituted amino group) (examples of $H_2N—G^{32}$ to be used for forming the group of $=NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^-$ represents hydrogen or a halogen atom (e.g., a fluorine atom, a chlorine atom, a bromine atom, etc.).

Specific examples of this type of Y are described in Japanese Patent Application (CPI) Nos. 3819/78 and 48534/79.

Other examples of Y of this type of compound are described in Japanese Patent Publication Nos. 32119/73 and 39165/73, Japanese Patent Application (OPI) No. 64436/74, U.S. Pat. No. 3,443,934, etc.

Still further examples of Y are those represented by formula (CVII)

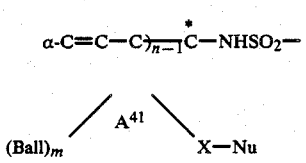

(CVII)

wherein $\alpha$ represents $OR^{41}$ or $NHR^{42}$; $R^{41}$ represents hydrogen or a hydrolyzable component; $R^{42}$ represents hydrogen, or an alkyl group containing from 1 to 50 carbon atoms; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having from 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined in the above described formula (CII). Specific examples of this type of Y are described in Japanese Patent Application (OPI) No. 20735/82.

As still further type of examples represented by formula (CI), there are dye providing nondiffusible substances which release a diffusible dye in the presence of a base as a result of self cyclization or the like but which, when reacted with an oxidation product of a developing agent, substantially never release the dye.

Examples of Y effective for this type of compound are those which are represented by formula (CVIII)

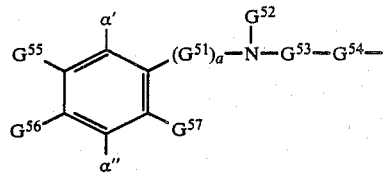

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having from 1 to 3 carbon atoms;

a represents 0 or 1;

$G^{52}$ represents a substituted or unsubstituted alkyl group having from 1 to 40 carbon atoms or a substituted or unsubstituted aryl group having from 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having from 1 to 10 carbon atoms or an aromatic residue having from 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having from 1 to 40 carbon atoms or an optional group defined for $G^{52}$, $G^{55}$ and $G^{56}$ may form a 5- to 7-membered ring, and $G^{56}$ may represent $—(G^{51})_a$

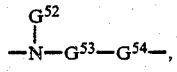

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by formulae (CIX) and (CX)

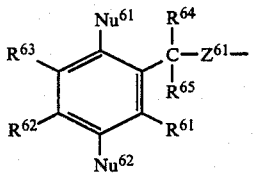

(CIX)

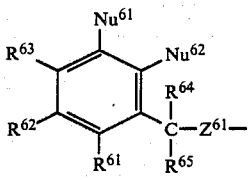

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above described compounds immobile. Specific examples of this type of Y are described in Japanese Patent Application (OPI) Nos. 69033/78 and 130927/79.

Further examples of Y suited for this type of compound are those which are represented by formula (CXI)

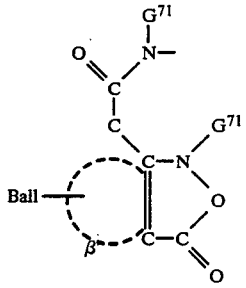

(CXI)

wherein Ball and $\beta'$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compound are those represented by formula (CXII)

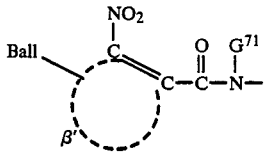

(CXII)

wherein Ball and $\beta'$ are the same as defined for those in formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by formula (CXIII)

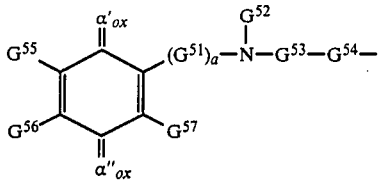

(CXIII)

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$ $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by formulae (CXIV-A) and (CXIV-B):

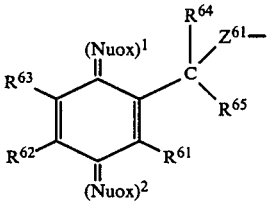

(CXIV-A)

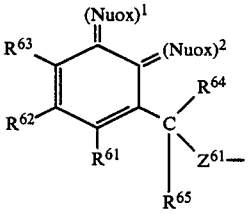

(CXIV-B)

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to formulae (CXII), (CXIII), (CXIV-A) and (CXIV-B) describe electron donors to be used in combination.

As still further different type of compound represented by formula (CI), there are illustrated LDA compounds (Linked Donor Acceptor Compounds). These compounds are dye providing nondiffusible substances which cause donor-acceptor reaction in the presence of a base to release a diffusible dye but, upon reaction with an oxidation product of a developing agent, they substantially do not release the dye any more.

Examples of Y effective for this type of compound are those represented by formula (CXV) (specific examples thereof being described in Japanese Patent Application (OPI) No. 60289/83):

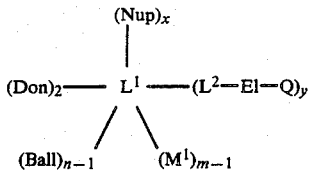

(CXV)

wherein n, x, y and z each represents 1 or 2, m represents an integer of 1 or more; Don represents a group containing an electron donor or its precursor moiety; $L^1$ represents an organic group linking Nup to —$L^2$—El—Q or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye providing substance nondiffusible, and is preferably a group containing a $C_{8-32}$ hydrophobic group. Such organic ballast group is bound to the dye providing substance directly or through a linking group (e.g., an imino bond, an ether bond, a thioether bond, a carbonamido bond, a sulfonamido bond, a ureido bond, an ester bond, an imido bond, a carbamoyl bond, a sulfamoyl bond, etc., and combination thereof).

Two or more kinds of the dye providing substances can be employed together. In such a case, two or more kinds of the dye providing substances may be used together in order to provide the same hue or in order to reproduce black color.

Typical examples of such compounds are set forth below, together with literature referring thereto.

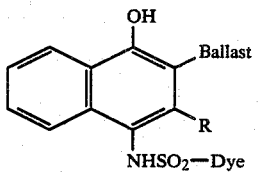

U.S. Pat. No. 3,928,312, etc.

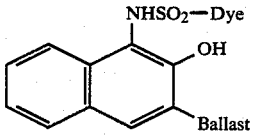

U.S. Pat. No. 4,053,312, etc.

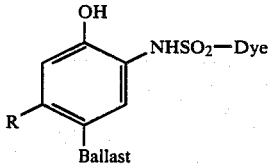

U.S. Pat. No. 4,055,428, etc.

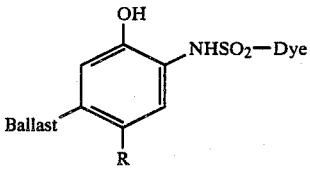

U.S. Pat. No. 4,336,322

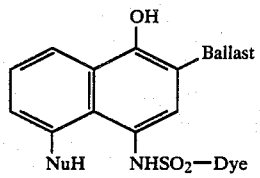

Japanese Patent Application (OPI) No. 65839/84

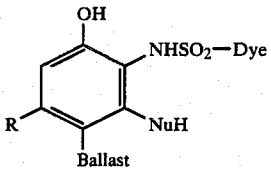

Japanese Patent Application (OPI) No. 69839/84

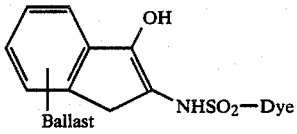

Japanese Patent Application (OPI) No. 3819/78

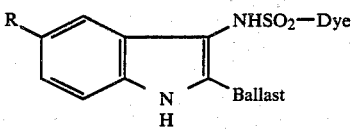

Japanese Patent Application (OPI) No. 104,343/76

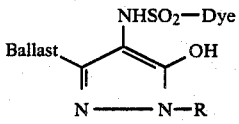

Japanese Patent Application (OPI) No. 104,343/76

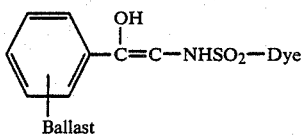

Japanese Patent Application (OPI) No. 104,343/76

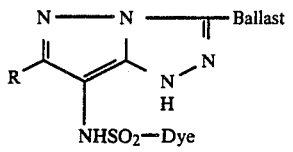

*Research Disclosure* No. 17465 (October, 1978)

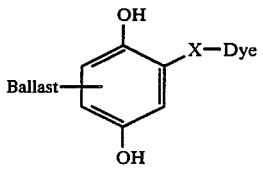

U.S. Pat. No. 3,725,062

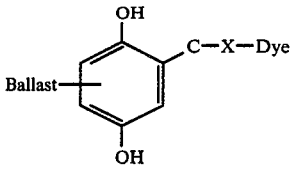

U.S. Pat. No. 3,728,113

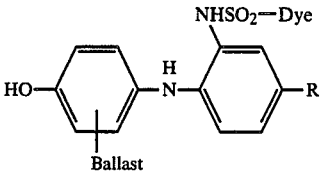

U.S. Pat. No. 3,443,939

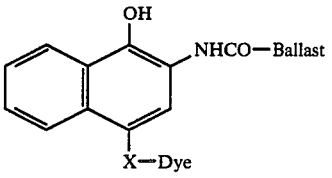

Japanese Patent Application (OPI) No. 116,537/83

The dye forming substance used in the present invention can be introduced into a layer of the light-sensitive material by known methods such as the method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of from about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents haveng a high boiling point and organic solvents having a low boiling point may be used as a mixture thereof.

Further, it is possible to use a dispersion method using a polymer se described in Japanese Patent Publication No. 39853/76 and Japanese Patent Application (OPI) No. 59943/76. Moreover, various surface active agents can be used when the dye providng substance is dispersed in a hydrophilic colloid. For this purpose, the surface active agents illustrated in other part of the specification can be used. The organic solvent having a high boiling point used in the present invention is used in an amount of not more than 10 g, preferably not more than 5 g per gram of the dye forming substance.

In the present invention, if necessary, a reducing agent may be used. The reducing agents used in the present invention include the following compounds.

Hydroauinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohesylcatachol, 3-methoxycatechol, 4-(N-octadecylamino)catechol, etc), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

More prefered reducing agents include, for example 3-pyrazolidone compounds (e.g., 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis-(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifuoroethyl)-4,4-dimethyl-3-pyrazolidone, and 5-methyl-3-pyrazolidone).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

In the present invention, a so-called auxiary developing agent may be used even when a reducible dye-forming material is used in the photographic material. The auxiary developing agent is oxidized by a silver halide to form an oxidation product which is able to oxidize the reducible moiety of the dye-forming material.

Examples of useful auxiliary developing agents include hydroquinone, alkyl substituted hydroquinones such as tertiary butylhydroquinone, 2,5-dimethylhydroquinone, etc., catechols, pyrogallols, halogen substituted hydroquinones such as chlorohydroquinone, dichlorohydroquinone, etc., alkoxy substituted hydroquinones such as methoxyhydroquinone, and polyhydroxybenzene derivatives such as methyl hydroxymaphthalene, etc. Further, methyl gallate, ascorbic acid, ascorbic acid derivatives, hydroxylamines such as N,N-di(2-ethoxyethyl)hydroxylamine, etc., pyraxolidoens such as 1-phenyl-3-pyrazolidone, 4-methyl-4-hydroxymethyl-1-phenyl-3-pyrazolidone, etc., reductones and hydroxy tetronic acids are useful.

The auxiliary developing agent can be used in an amount of a fixed range. A suitable range is 0.0005 time by mol to 20 times by mol based on silver. A particularly suitable range in 0.001 time by mol to 4 times by mol.

A silver halide is preferably used in the present invention. Examples of a silver halide include silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to porassium bromide solution to form silver bromide particles and then adding pottasium iodide to the mixture.

Two or more kinds of silver halides in which a particle size and/or a halogen composition are different from each other may used in mixture.

An average particle size of the silver halide used in the present invention is preferably from 0.01 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149–169.

The amount of the photographic silver halide to be coated in the photographic material of the present invention falls within the range of 1 mg/m$^2$ to 10 g/m$^2$, as calculated in terms of the content of silver therein.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

In said embodiment, a silver halide to be used does not necessarily contain a pure silver iodide crystal, which is, however in dispensable in such case that a silver halide is used singly (that is, without co-use of said organic silver salt), but any and every silver halide which is conventionally and widely used in this technical filed may be used.

Examples of such organic silver salt oxidizing agents include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc.,. a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* RD No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* RD No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 mg/m$^2$ to 10 g/m$^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In addition, azole-thioethers and blocked azoline-thione compounds as described in Bergian Pat. No. 768,071; 4-aryl-1-carbamyl-2-tetrazoline-5-thione compounds as described in U.S. Pat. No. 3,893,859; and compounds as described in U.S. Pat. Nos. 3,839,041, 3,844,788 and 3,877,940 are also preferably used in the present invention.

The photosensitive material of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

The above described bases or base precursors can be used not only for the acceleration of dye release but also for other purposes such as the control of a pH value.

The above described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above described manner, migration of additives among constituent layers of a heat developable photosensitive material can be reduced. Therefore, such distribution of additives is of advantage to some cases.

The heat developable photosensitive materials of the present invention are effective in forming both negative and positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by image-wise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light emitting diodes, etc.

In the present invention, after the heat developable color photographic material is exposed to light, the resulting latent image can be developed by heating the whole material to a suitably elevated temperatures. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, stytyl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a super-sensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyester acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used alone or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the interlayer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and anti-irradiation dyes, hardeners, mordants, and so on, are those described in U.S. Pat. Nos. 4,500,626, 4,478,927, 4,463,079, and Japanese Patent Application (OPI) No. 154,445/84 (corresponding to U.S. patent application Ser. No. 582,655, filed on Feb. 23, 1984) and U.S. Pat. No. 4,503,137. Methods for the exposure, and so on, cited in the above described patents can be employed in the present invention also.

The present invention will be explained in greater detail by reference to the following examples, which, however, are not intended to be interpreted as limiting the scope of the present invention.

EXAMPLE 1

A silver benzotriazole emulsion was prepared as follows:

28 g of gelatin and 13.2 g of benzotriazole were dissolved in 3000 ml of water. The solution formed was kept at 40° C. and stirred. A solution of 17 g of silver nitrate dissolved in 100 ml of water was added to said solution over the course of 2 minutes.

The pH value of this silver benzotriazole emulsion was regulated and sedimented, to remove the excess salt therefrom. Afterwards, the pH value thereof was adjusted to 6.30, to obtain 400 g of the desired silver benzotriazole emulsion.

Next, a silver halide emulsion (A) was prepared as follows:

600 ml of an aqueous solution containing 0.11 mole of sodium chloride and 0.48 mole of potassium bromide and a silver nitrate aqueous solution (containing 0.59 mole of silver nitrate dissolved in 600 ml of water) were simultaneously added to a well-stirred gelatin-aqueous solution (containing 20 g of gelatin and 3 g of sodium chloride dissolved in 1000 ml of water and warmed at 75° C.), in the course of 40 minutes, at the same addition-flow rate. Thus, a mono-dispersed cubic silver bromochloride emulsion (bromine content: 80 mole%) having an average grain size of 0.35 μm was obtained.

After washed with water and demineralized, 5 mg of sodium thiosulfate and 20 mg of 4-hydroxy-6-methyl-1,3,3a,7-tetrazaindene were added to the emulsion obtained and heated at 60° C. for chemical sensitization thereof.

The yield of the emulsion was 600 g.

Next, a gelatin-dispersion of a dye-forming substance was prepared as follows:

5 g of a cyan-dye-forming substance (A) (as given hereinafter), 0.5 g of 2-ethylhexyl succinate/sodium sulfonate (as surfactant) and 10 g of tri-isononyl phosphate were weighed, and 30 ml of ethyl acetate was added thereto and heated at about 60° C. and dissolved, to obtain a uniform solution. The resultant solution was blended with 100 g of 10%-solution of a lime-treated gelatin, while stirred, and then dispersed in a homogenizer for 10 minutes (10,000 rpm) to obtain a cyan-dye-forming substance dispersion.

(A)

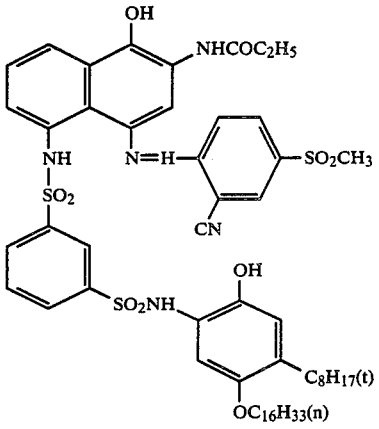

Next, a photographic coating composition (A) was prepared as follows:

| | |
|---|---|
| (a) Silver benzotriazol emulsion | 10 g |
| (b) Photographic silver bromochloride emulsion (A) | 15 g |
| (c) dispersion of dye-forming substance | 25 g |
| (d) 5%-aqueous solution of the following compound: | 5 ml |

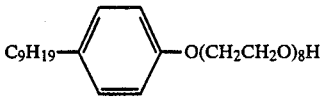

| | |
|---|---|
| (e) 10%-methanol solution of benzenesulfonamide | 5 ml |
| (f) 10%-aqueous solution of guanidine 4-methylsulfonyl-phenylsulfonyl-acetate | 15 ml |
| (g) 0.04%-methanol solution of the sensitizing dye shown in Table 1 | 4 ml |

The above components (a) through (g) were blended, and a tackfier and water were added thereto to make 100 ml in all. The resultant solution was coated on a polyethylene terephthalate film having a thickness of 180 μm, to form a coat-film having a wet film thickness of 50 μm.

Next, a coating composition for a protective layer was prepared as follows:

| Coating composition for protective layer: | |
|---|---|
| (h) 10%-gelatin aqueous solution | 400 g |
| (i) 10%-aqueous solution of guanidine 4-methylsulfonyl-phenylsulfonyl-acetate | 240 ml |
| (j) 4%-aqueous solution of a hardener of the following formula: $CH_2{=}CH{-}SO_2CH_2CONH{-}(CH_2)_2{-}NHCOCH_2SO_2CH{=}CH_2$ | 50 ml |

The above components (h) through (j) were blended, and a tackifier and water were added thereto to make 1000 ml in all.

The obtained coating composition was super-coated on the above formed film coated with the photographic coating composition to form a protective layer having a thickness of 30 μm.

Thus formed sample was dried, and then imagewise exposed to a tungsten lamp of 2000 luxes, through SC-72 Filter (trademark for product manufactured by Fuji Photo Film Co., Ltd.), for one second.

Afterwards, the thus exposed sample was uniformly heated on a heat block heated at 140° C. for 30 seconds.

Next, a dye-fixing material was prepared as follows:

10 g of poly(methyl acrylate-co-N,N,N-trimethyl-N-vinylbenzylammonium chloride) (molar ratio of methyl acrylate to vinylbenzylammoinum chloride=1/1) was dissolved in 200 ml of water, and the resultant solution was uniformly blended with 100 g of 10%-lime-treated gelatin aqueous solution. The formed mixture solution was uniformly coated on a paper support laminated with a titanium dioxide-dispersed polyethylene, to form a coated film having a wet film thickness of 90 μm. Thus formed sample was dried, and used as a dye-fixing material having a mordanting layer.

Next, water was applied to the surface of the coated layer of said dye-fixing material, in an amount of 20 ml/m$^2$, and then the above-exposed photographic material, after being heated, was superposed thereto so that the both surfaces of the coated films of both sheets faced to each other.

The thus superposed sample was heated on a heat-block at 80° C. for 6 seconds, and thereafter the dye-fixing material was peeled off from the photographic material, whereby a cyn-image was formed on said dye-fixing material. The density of the formed image was measured by the use of Macbeth Reflection Densitometer (RD-519). The result is given in the following Table 1.

TABLE 1

| Sample No. | Compound (Sensitizing dye) | Fresh sample Relative sensitivity | Fresh sample Fog | After preserved for 3 days at 50° C. Relative sensitivity | After preserved for 3 days at 50° C. Fog | After preserved for 3 days at 40° C.-80% RH Relative sensitivity | After preserved for 3 days at 40° C.-80% RH Fog |
|---|---|---|---|---|---|---|---|
| I | 1 | 120 | 0.15 | 110 | 0.16 | 115 | 0.15 |
| II | 2 | 130 | 0.16 | 120 | 0.17 | 120 | 0.15 |
| III | 7 | 115 | 0.15 | 100 | 0.17 | 80 | 0.16 |
| IV | 9 | 100 | 0.15 | 80 | 0.17 | 75 | 0.17 |
| V | 27 | 105 | 0.18 | 90 | 0.20 | 95 | 0.18 |
| VI | 31 | 110 | 0.16 | 95 | 0.17 | 105 | 0.17 |
| VII | Comparative compound (a) | 85 | 0.15 | 65 | 0.17 | 50 | 0.17 |

Comparative compound (a)

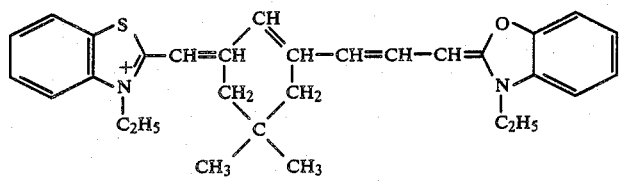

The relative sensitivity given in the above Table 1 is designated by an antilogarithmic number on the basis of the sensitivity of the corresponding fresh sample which is provided as 100.

The above results prove that the photographic materials each containing the sensitizing dye of the present invention have higher sensitivity and better preservation stability than the photographic material containing the Comparative compound (a).

EXAMPLE 2

In the same manner as in the Example 1, with the exception that a sensitizing dye (51), (53), (58), (68) or (71) was used instead of the sensitizing dye (1) in the Sample No. (I), photographic materials (XI) through (XV) were formed. These were treated analogously to the Example 1, and results are given in the following Table 2.

TABLE 2

| Sample No. | Compound (Sensitizing dye) | Maximum density | Minimum density | γ | Relative sensitivity after preserved for one day at 50° C.(*) |
|---|---|---|---|---|---|
| XI | (51) | 1.7 | 0.14 | 3.5 | 95 |
| XII | (53) | 1.7 | 0.15 | 3.0 | 92 |
| XIII | (58) | 1.6 | 0.12 | 2.8 | 85 |
| XIV | (68) | 1.8 | 0.13 | 2.9 | 97 |
| XV | (71) | 1.7 | 0.12 | 3.2 | 95 |

(*) Designated by antilogarithmic number based on the sensitivity of the corresponding fresh sample of 100.

The above results prove that the sensitizing dyes of the present invention are advantageous as being almost free from deterioration of the sensitivity thereof during preservation.

EXAMPLE 3

24 g of gelatin, 1 g of potassium bromide and 10 ml of 25%-aqueous ammonia were dissolved in one liter of water to form a Solution-I. This solution was kept at 50° C. and stirred. Next, Solution-a comprising 100 g of silver nitrate dissolved in one liter of water and Solution-b comprising 63 g of potassium bromide and 12 g of potassium iodide dissolved in one liter of water and Solution-c comprising 0.02 g of a sensitizing dye 2 dissolved in 300 ml of methanol were simultaneously added to said Solution-I, in the course of 50 minutes, to obtain a silver bromoiodide emulsion (B).

In the same manner as in the above Example 1, with the exception that 15 g of the above obtained emulsion (B) was used instead of 15 g of the emulsion (A) used in the Example 1, photographic sample (XVI) was formed, which was treated analogously to said Example 1. The results are set forth below.

TABLE 3

| Sample | Maximum density | Minimum density | γ |
|---|---|---|---|
| XVI | 1.6 | 0.19 | 2.4 |

EXAMPLE 4

In the same manner as in Example 1 using the sensitizing dye 4, a photographic sample (XVII) was formed. Apart from this, another photographic sample (b) (comparative sample) was formed, using a sensitizing dye (b) shown below, for comparison. Photographic characteristics of these samples (fresh samples and samples after being preserved for one day at 50° C.) were tested, and the results are given below. These results prove that the present samples are superior to the other comparative samples.

Sensitizing dye (b)

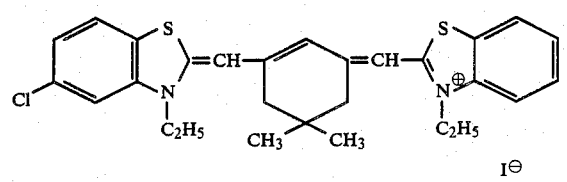

TABLE 4

| Sample No. | Fresh sample: Relative sensitivity | Fresh sample: Fog | After preservation for one day at 50° C.: Relative sensitivity | After preservation for one day at 50° C.: Fog |
|---|---|---|---|---|
| XVII | 100 | 0.13 | 91 | 0.15 |
| b | 70 | 0.16 | 42 | 0.19 |

The relative sensitivity given in the above Table 4 is designated by an antilogarithmic number on the basis of the sensitivity of a fresh sample (XVII) which is 100.

EXAMPLE 5

In the same manner as in Example 1, with the exception that a magenta-dye-forming substance (E) (as given below) was used instead of the dye-forming substance (A) used in Example 1 and that a sensitizing dye (53), (54), or (75) was used instead of the sensitizing dye (1) in the sample No. (I) of said Example 1, photographic materials (XXI), (XXII) and (XXIII) were formed. These were treated analogously to Example 1, and results are given in the following Table 5.

TABLE 5

| Sample No. | Fresh sample: Relative sensitivity | Fresh sample: Fog | After preservation for one day at 50° C.: Relative sensitivity | After preservation for one day at 50° C.: Fog |
|---|---|---|---|---|
| XXI | 120 | 0.12 | 115 | 0.13 |
| XXII | 110 | 0.14 | 108 | 0.17 |

TABLE 5-continued

| Sample No. | Fresh sample Relative sensitivity | Fresh sample Fog | After preservation for one day at 50° C. Relative sensitivity | After preservation for one day at 50° C. Fog |
|---|---|---|---|---|
| XXIII | 90 | 0.13 | 75 | 0.14 |

Dye-forming substance (B)

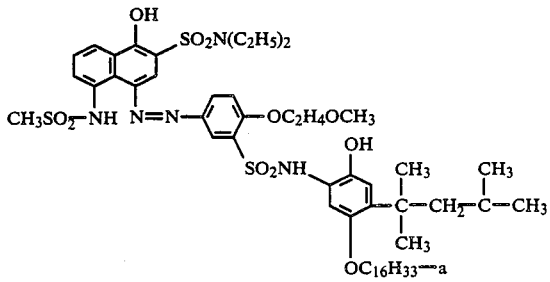

While the invention has been descirbed in detail and with reference to specific embodiments thereof, it will be apparent to one skilled in the art that various changes and modifications can be made therein without departing from the spirit and scope thereof.

What is claimed is:

1. A heat-developable light-sensitive silver halide photographic material comprising a support having thereon at least one heat-developable photographic layer and comprising a silver halide emulsion, an alkali or alkali precursor and/or a mobile dye precursor, said photographic material containing an infra-red sensitizing dye represented by formula (I)

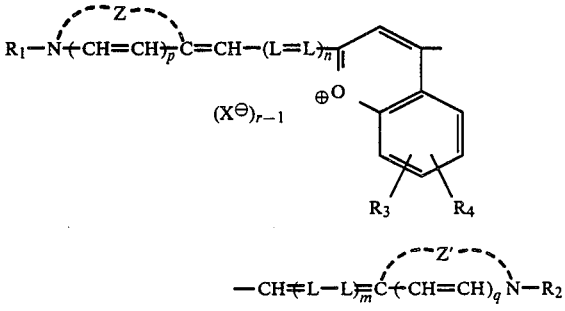

wherein n and m each represents 0, 1, 2 or 3;

p and q each represents 0 or 1;

L represents a methine group or a substituted methine group;

$R_1$ and $R_2$ are same or different and each represents an unsubstituted or substituted alkyl group;

$R_3$ and $R_4$ are same or different and each represents a hydrogen atom, an alkyl group, an alkoxy group, a hydroxyl group, an unsubstituted or substituted amino group or a halogen atom; or said $R_3$ and $R_4$ form a condensed 6-membered ring;

Z and Z' are same or different and each represents a non-metallic atomic group necessary for forming a substituted or unsubstituted 5-membered or 6-membered ring, or substituted or unsubstituted 5-membered or 6-membered ring which is condensed with another ring;

$X^{\ominus}$ represents an anion;

r represents 1 or 2, and when the dye forms an internal salt, r is 1.

2. A heat-developable photographic material as in claim 1, wherein the substituent of $R_1$ and $R_2$ is selected from the group consisting of a carboxyl group, a sulfo group, $—COO^{\ominus}$, $—SO_3^{\ominus}$, a cyano group, a halogen atom, a hydroxyl group, a substituted or unsubstituted alkoxycarbonyl (having from 2 to 8 carbon atoms), aryloxycarbonyl (having from 7 to 8 carbon atoms), alkoxy (having from 1 to 8 carbon atoms), mono-cyclic aryloxy (having from 6 to 10 carbon atoms), alkylcarbonyloxy (having from 2 to 8 carbon atoms), arylcarbonyloxy (having from 7 to 8 carbon atoms), alkysulfonyl (having from 1 to carbon atoms), arylsulfonyl (having from 6 to carbon atoms), carbamoyl, sulfamoyl, and aryl (having from 6 to 10 carbon atoms) group.

3. A heat-developable photographic material as in claim 1, wherein L in said formula (I) represents an unsubstituted methine group or a methine group substituted by at least one substituent selected from the group consisting of an alkyl group having from 1 to 4 carbon atoms, an aryl-substituted alkyl group having from 7 to 10 carbon atoms, and an aryl group having from 6 to 10 carbon atoms, or substituents of L may form a ring with carbon atoms of L.

4. A heat-developable photographic material as in claim 1, wherein $R_3$ and $R_4$ each represents a hydrdogen atom, an alkyl group having from 1 to 4 carbon atoms, an alkoxy group having from 1 to 4 carbon atoms, a hydroxyl group, a halogen atom or an unsubstituted or substituted amino group of formula:

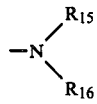

wherein $R_{15}$ and $R_{16}$ are same or different and each represents a hydrogen atom, a lower alkyl group having from 1 to 4 carbon atoms, an alkylcarbonyl group having from 2 to 8 carbon atoms, or an arylcarbonyl group having from 7 to 8 carbon atoms; or $R_{15}$ and $R_{16}$ together form a 5-membered or 6-membered ring; or $R_{15}$ and/or $R_{16}$ is condensed with the benzene ring of the benzopyrylium nucleus to form a condensed ring.

5. A heat-developable photohgraphic material as in claim 1, wherein Z and Z' are same or different and each represents a substituted or unsubstituted thiazole, benzothiazole, naphthothiazole, oxazole, benzoxazole, naphthoxazole, selenazole, benzoselenazole, napahthoselenazole, imidazole, benzimidazole, naphthoimidazole, thiazoline, imidazoquinoline, imidazo[4,5-b]quinoxaline, oxazoline, isoxazole, benzisoxazole, 3,3-dialkylindolenine, 2-pyridine, 4-pyridine, 2-quinoline, 4-quinoline or 1-isoquinoline nucleus.

6. A heat-developable photographic material as in claim 1, wherein the substituent for the ring or condensed ring represented by Z or Z' is selected from the group consisting of a halogen atom, an alkyl group, an aryl group, a trifluoromethyl group, an alkoxy group, a carboxy group, a cyano group and a hydroxy group.

7. A heat-developable photographic material as in claim 1, wherein $X^{\ominus}$ represents an anion selected from the group consisting of a chloride, bromide, iodide, thiocyanate, perchlorate, paratoluenesulfonate and tetrafluoroborate ions.

8. A heat-developable photographic material as in claim 1, wherein said mobile dye precursor of formula (I) is incorporated in a silver halide emulsion layer provided on the support as the heat-developable photographic layer.

9. A heat-developable photographic material as in claim 1, wherein the amount of said dye of the formula (I) is from $10^{-8}$ to $10^{-2}$ mole per mole of a silver halide.

10. A heat-developable photographic material as in claim 1, wherein said photographic material contains a alkali or a alkali precursor.

11. A heat-developable photographic material as in claim 10, wherein the amount of said alkali or alkali precursor is not more than 50 wt% based on the total weight of coated layer(s) of the photographic material.

12. A heat-developable photographic material as in claim 10, wherein the amount of said alkali or alkali precursor is from 0.01 to 40 wt% based on the total weight of coated layer(s) of the photographic material.

13. A heat-developable photographic material as in claim 1, wherein said photographic material contains a mobile dye precursor.

14. A heat-developable photographic material as in claim 13, wherein said mobile dye precursor is selected from the group consisting of a coupler, a dye to which a nitrogen-containing heterocyclic group have been introduced, dye which is used in a silver dye bleach process for heat-development, a leuco dye, and a dye-forming substance capable of imagewise releasing a diffusive dye.

15. A heat-developable photographic material as in claim 14, wherein said dye-forming substance capable of imagewise releasing a diffusive dye is represented by formula (CI)

$$(\text{Dye-X})_q\text{—Y} \qquad \text{(CI)}$$

wherein Dye represents a dye which becomes mobile when it is released from the molecule of the compound represented by formula (CI); X represents a chemical bond or a linking group; Y represents a group which releases Dye in correspondence or counter-correspondence to light-sensitive silver salts having a latent image distributed imagewise, the diffusibility of Dye released being different from that of the compound represented by formula (CI), q is an integer of 1 or 2, and when q is 2, the two (Dye-X) are the same or different.

16. A method for producing an image, which comprises heat developing a light-exposed heat developable light-sensitive silver halide photographic material comprising a support and formed thereon at least one heat developable photographic layer and comprising a silver halide emulsion, an alkali or alkali precursor and/or a mobile dye precursor, said photographic material containing an infra-red sensitizing dye represented by formula (I)

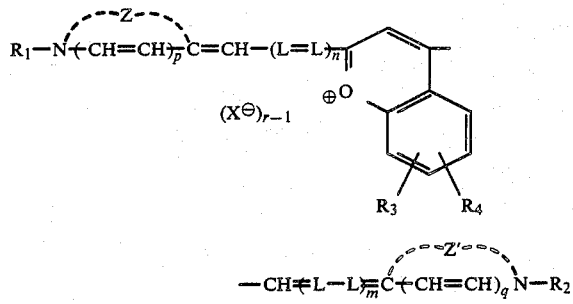

wherein n and m each represents 0, 1, 2 or 3;

p and q each represents 0 or 1;

L represents a methine group or a substituted methine group;

$R_1$ and $R_2$ are same or different and each represents an unsubstituted or substituted alkyl group;

$R_3$ and $R_4$ are same or different and each represents a hydrogen atom, an alkyl group, an alkoxy group, a hydroxyl group, an unsubstituted or substituted amino group or a halogen atom; or said $R_3$ and $R_4$ form a condensed 6-membered ring;

Z and Z' are same or different and each represents a non-metallic atomic group necessary for forming a substituted or unsubstituted 5-membered or 6-membered ring, or substituted or unsubstituted 5-membered or 6-membered ring which is condensed with another ring;

$X^{\ominus}$ represents an anion;

r represents 1 or 2, and when the dye forms an internal salt, r is 1.

17. A heat-developable photographic material as in claim 1, wherein the heat-developable photographic material contains:

a dye-forming substance;

an organic silver salt;

a reducing agent; and a developing activator.

18. A heat-developable photographic material as in claim 1, wherein the heat-developable photographic material contains an alkali or an alkali precursor and/or a mobile dye precursor.

19. A method as in claim 16, wherein the heat-developable photographic material contains at least one of:

a base;

a base precursor;

a dye-forming substance;

an organic silver salt;

a reducing agent; and a developing activator.

20. A method as in claim 16, wherein the heat-developable photographic material contains an alkali or an alkali precursor and/or a mobile dye precursor.

21. A method as in claim 16, wherein the light-exposed heat-developable light-sensitive silver photographic material contains a silver halide emulsion which has been color sensitized with a sensitizing dye and an alkaline agent or an alkali precursor or contains a silver halide emulsion which has been color sensitized with a sensitizing dye and a compound capable of releasing a mobile dye corresponding to or inversely corresponding to a reduction reaction to reduce the silver halide to silver at a high temperature.

* * * * *